US008337947B2

(12) United States Patent
Camorani

(10) Patent No.: US 8,337,947 B2
(45) Date of Patent: Dec. 25, 2012

(54) DECORATING WITH POWDER MATERIAL

(75) Inventor: Carlo Antonio Camorani, Castellarano (IT)

(73) Assignee: System S.p.A., Fiorano Modenese (IT)

( * ) Notice: Subject to any disclaimer, the term of this patent is extended or adjusted under 35 U.S.C. 154(b) by 1161 days.

(21) Appl. No.: 12/279,490

(22) PCT Filed: Feb. 21, 2007

(86) PCT No.: PCT/IB2007/000419

§ 371 (c)(1),
(2), (4) Date: Aug. 14, 2008

(87) PCT Pub. No.: WO2007/096746

PCT Pub. Date: Aug. 30, 2007

(65) Prior Publication Data

US 2009/0010682 A1 Jan. 8, 2009

(30) Foreign Application Priority Data

| | | |
|---|---|---|
| Feb. 21, 2006 | (IT) | MO2006A0058 |
| Feb. 21, 2006 | (IT) | MO2006A0059 |
| Feb. 21, 2006 | (IT) | MO2006A0060 |
| Feb. 21, 2006 | (IT) | MO2006A0061 |
| Apr. 26, 2006 | (IT) | MO2006A0135 |

(51) Int. Cl.
*B05D 1/28* (2006.01)

(52) U.S. Cl. .... 427/197; 427/201; 427/204; 427/428.06

(58) Field of Classification Search ..... 427/197, 427/201, 204, 428.06
See application file for complete search history.

(56) References Cited

U.S. PATENT DOCUMENTS

| | | | | |
|---|---|---|---|---|
| 3,530,794 | A * | 9/1970 | Ritzerfeld | 101/216 |
| 5,368,791 | A | 11/1994 | Uchida et al. | |
| 5,477,781 | A | 12/1995 | Stefani | |
| 5,612,081 | A * | 3/1997 | Orr et al. | 427/8 |
| 5,640,659 | A | 6/1997 | Thompson et al. | |
| 5,715,508 | A | 2/1998 | Berkers et al. | |
| 5,736,084 | A | 4/1998 | Uchida et al. | |
| 5,841,456 | A | 11/1998 | Takei et al. | |
| 5,890,043 | A | 3/1999 | Uehara | |
| 5,988,068 | A | 11/1999 | Van Ritter et al. | |
| 6,386,696 | B1 | 5/2002 | Rodi et al. | |
| 7,178,459 | B2 | 2/2007 | Stefani | |
| 7,399,823 | B1 | 7/2008 | Selsted et al. | |
| 2003/0156178 | A1 | 8/2003 | Lehmann | |
| 2004/0094260 | A1 | 5/2004 | Summerfield | |
| 2004/0101619 | A1 | 5/2004 | Camorani | |
| 2006/0000373 | A1 | 1/2006 | Stefani | |

FOREIGN PATENT DOCUMENTS

| | | |
|---|---|---|
| DE | 19746174 | 7/1999 |
| EP | 0097134 | 12/1983 |
| EP | 0479512 | 4/1992 |

(Continued)

*Primary Examiner* — Frederick Parker
(74) *Attorney, Agent, or Firm* — Pearne & Gordon LLP

(57) ABSTRACT

A method for applying a pattern of granular material on a receiving surface includes in sequence the following steps:

associating the granular material with a transferring surface together with a liquid aggregating phase and according to a prefiguration of the pattern;

facing the transferring surface carrying the granular material and the liquid phase to the receiving surface in a transferring zone;

heating at least one portion of the liquid phase in the transferring zone in order to detach the granular material from the transferring surface and applying the granular material on the receiving surface.

8 Claims, 22 Drawing Sheets

FOREIGN PATENT DOCUMENTS

| | | | |
|---|---|---|---|
| EP | 0515098 | | 11/1992 |
| EP | 0530627 | | 3/1993 |
| EP | 0635369 | | 1/1995 |
| EP | 0641008 | | 3/1995 |
| EP | 0659526 | | 6/1995 |
| EP | 0677364 | | 10/1995 |
| EP | 0727778 | | 8/1996 |
| EP | 0769728 | | 4/1997 |
| EP | 0829333 | | 3/1998 |
| EP | 0834784 | | 4/1998 |
| EP | 0927687 | | 7/1999 |
| EP | 1162047 | | 12/2001 |
| EP | 1170104 | | 1/2002 |
| EP | 1266757 | | 12/2002 |
| EP | 1419863 | | 5/2004 |
| EP | 1593513 | | 11/2005 |
| GB | 1326263 | | 8/1973 |
| SU | 1751254 | A1 | 7/1992 |
| WO | WO9518020 | | 7/1995 |
| WO | WO9823424 | | 6/1998 |
| WO | WO0172489 | | 10/2001 |
| WO | WO2004028767 | | 4/2004 |
| WO | 2005/025828 | * | 3/2005 |
| WO | WO2005025828 | | 3/2005 |
| WO | WO2005025828 | A | 3/2005 |
| WO | WO2007096746 | | 8/2007 |

* cited by examiner

DECORATING WITH POWDER MATERIAL

FIELD OF THE INVENTION

The invention relates to systems and apparatuses for transferring granular material to a surface to be decorated, particularly for obtaining decorations on ceramic tiles, optionally also according to a pattern controlled in real time by computerized means.

DESCRIPTION OF RELATED ART

Decorating technologies are known providing for associating the decorating material to a transferring surface, which is movable along a loop path, and then causing the decorating material to pass to the surface to be decorated. A number of practical applications exist that differentiate mainly in the manner of associating the decorating material to the transferring surface and in the manner of transferring the decorating material to the surface to be decorated. This latter phase can occur with contact, by making use of the adhesive effect towards the surface to be decorated, or without contact with the aid of other forces.

Examples of passage with contact are disclosed in EP530627, EP635369, EP677364, EP727778, EP769728, EP834784, U.S. Pat. No. 5,890,043, IT1287473, IT1304942, IT1310834 and IT1314624.

A feature which is common to all these mentioned examples is that during passage the decorating material has to be in a state of liquid suspension or possibly at the molten state, just for exploiting the adhesive effect towards the receiving surface. The direct interaction with the surface to be decorated constitutes therefore a remarkable operative limit, for example, incoherent, humid or rough surfaces can not be decorated and further the transferring surface can be somehow altered or dirtied in the contact.

In IT1262691 the humid or dry decorating material is firstly incorporated in cavities of a belt transferring surface for being then projected on the surface to be decorated by effect of an ultrasonic vibration transmitted through the transferring surface.

The use of ultrasonic equipment involves complications, high costs and waste of energy. In addition remarkable difficulties exist in transmitting the vibrations in uniform manner to all the width of the transferring surface, mainly when the transferring surface exceeds 200-250 mm. Limitations also exist for low operating speed and incomplete transferring of the decoration.

IT1262691 further discloses a system providing to incorporate decorating material in the through openings of a reticular matrix and then to project the decorating material on the surface to be decorated, without contact, by effect of an air jet. The expulsion by means of air jet dramatically distorts the arrangement of the decoration on the receiving surface and can also produce environment pollution.

In EP1170104 it is provided to insert decorating powders into cavities of a rotating matrix and then to let the powders to fall when the powders face the surface to be decorated. Along the approaching path, the powders are maintained inside the cavities through supporting retaining means, consisting of sliding or rolling wrapping screens.

A drawback of EP1170104 is the uncertain detachment of the decoration when the effect of the retaining means is missing, mainly in the case that thin powders are used. Furthermore, in the case of sliding screen wears and seeping are inevitable, in the case of rolling screen the decomposition of the decoration during the fall is inevitable, since the lower wrapping means has to have certain overall dimensions.

In EP1419863 it is provided to compress the powdered decorating material into cavities of a belt rotating matrix and then to eject the powdered decorating material by elastically extending and deforming the matrix. Also in this case remarkable problems of wears, difficulties in retaining the material inside the cavities in reliable manner and as many difficulties in the phase of ejecting the material exist, which difficulties are mainly related with the criticality of the physical properties of the powdered material.

EP1162047, EP1266757 and WO2004028767 disclose dry decorating systems providing the passage of the powder through the holes of a movable laminar or reticular matrix. These systems have problems of wears produced by the abrasive granular material, which, mainly when it is forced by a doctor blade, continuously scrapes against the internal surface of the matrix and against the side walls of the holes. Difficulties also exist in maintaining constant the amount of material passing through the matrix. Furthermore, since the size of the holes has to be such as to enable the granules to pass easily, the obtainable definition is thereby limited.

In IT1314624 it is provided to apply to a transferring rotating surface a pattern formed by liquid micro-drops that are projected with "inkjet" technology. Subsequently, the powdered decorating material is caused to adhere to the micro-drops, which powdered decorating material is then transferred to the surface to be decorated. This passage is obtained either by direct contact, or, in another case, without contact by effect of ultrasonic vibration transmitted to the transferring surface. IT1314624 has the advantage of requiring no matrix with preformed pattern, however, in the phase in which the decoration passes to the surface to be decorated, IT1314624 has some of the disadvantages already mentioned, i.e. the contact or the use of vibrating devices.

In WO2005025828 a system is disclosed for detaching the granular material from the transferring surface by means of scraping means.

A drawback of WO2005025828 is the decomposition of the pattern arising in a more and more evident manner as the operative speed increases. This is caused by the fact that the granular material that has been so detached does not have a component of horizontal speed which is uniform in all the particles and which is synchronous with the surface to be decorated. In other words, the scraping means is a diffuser, since it reduces the advancing speed of each single particle in a more or less emphasized measure and it also deviates the trajectory thereof according to different directions. This decomposition is moreover emphasized by the fact that, having to be in a dry condition in order to do not clot onto the scraping means, the granular material does not firmly attach on the surface to be decorated but it stops on the latter in a more or less disordered manner after having bounced or gone along a certain stretch by sliding over the surface.

Furthermore, since the scraping means and the surface to be decorated can undergo a mutual damage in a possible sliding contact, a certain safety distance has to be maintained between the transferring surface and the surface to be decorated.

A further drawback is due to the continuous friction between scraping means and transferring surface, that wears and deteriorates these two elements.

A further drawback of WO2005025828 is dirtying of the scraping means, which scraping means is necessarily placed in a position that is critical and difficult to be accessed for cleaning. The drawback mainly shows with the thin powders, which normally are ever present at least in small amount in any granular material also because the thin powders tend to form spontaneously by breaking up of the granules. These thin powders, even when dry, tend to aggregate on the scraping means and then to fall casually in clotted form and in uncontrolled manner. Actually, cleaning means or movable scraping means may be provided, which means however are a complication and anyway do not solve completely the problem.

Systems are known for causing the decoration to pass from a transferring surface, which are based on principles of electrostatic attraction. These systems are limited in the fact that they can be used only with specific and particular decorating powders and only for certain products to be decorated, and, in fact, they never could find practical application in the field of the ceramic industry.

Apparatuses are known providing for supplying granular material through pluralities of openings that are arranged in series, the activation of which is controlled by valves that are connected with computer means. Examples of these apparatuses are disclosed in IT1294915, IT1311022 and in the Italian Patent Application RE2000A000040.

In these apparatuses the size of the openings has to be such as to enable the powder to freely flow out, thus no acceptable image definition can be obtained but only spots or veins with shaded contours. Furthermore, the various electromechanical devices make the apparatus complicate, expansive and not very reliable.

Inkjet decorating systems are further known for the ceramic field in which the decorating ink is directly projected on the surface of the product. The ceramic pigment passing through the ejectors of the inkjet device can be a very diluted thin suspension of solid material (nanoparticles) or a metallic complex in solution. In both cases, wears, obstructions and chemical attacks can occur on the delicate and expensive inkjet apparatus. Furthermore these inks, which moreover result very special and expensive, at the high temperatures have a poor chromatic power and enable no substantial contribution of material.

One of the systems disclosed in IT1314624 for applying the powdered material to the transferring surface, provides the use of a roller in rolling and synchronous contact with the transferring surface. A thin layer of the powdered material is maintained adherent to the surface of the roller by means of a knurling, or, being the surface of the roller permeable, as an effect of a vacuum acting from the interior.

A drawback of this system is that the contact is however necessary between the surface of the roller and the transferring surface, which causes difficulty of regulation and a dangerous interaction between the two surfaces in contact, which moreover forces to maintain a perfect synchronism between the two surfaces in order to do not alter the arrangement of the micro-drops.

Furthermore, the powdered material, which is unavoidably slightly compressed in the contact, transfers in an uncontrolled manner, that is, the powdered material either can not detach at all from the roller, or can detach in the form of agglomerates of excessive size. Furthermore, since the surface portion is the only portion of granular material involved in transferring, the underlying material is not renewed and becomes more and more compact during functioning, causing the knurling and/or the effect of the vacuum to be substantially ineffective.

The effect of the vacuum is also destined to progressively weaken due to the obstruction of the porous surface, to which porous surface moreover suitable cleaning means can not be applied.

A further system disclosed in IT1314624 provides for moving the granular material and projecting the latter towards the transferring surface by means of an air blow or vibrating means. A drawback of this system is that the system can generate unacceptable granulometric separations. Furthermore, since the granular material tends in time to accumulate in side idle zones with respect to the blowing/vibration zone, the effectiveness of the system tends to weaken in time. Furthermore, this system works in an unbalanced manner when dispensing the material from the supply hopper. In fact, depending on the relative position between the blowing/vibrating means and the distributing outlet of the hopper and the intensity of blowing/vibration and irrespective of the amount of granular material that is subtracted from the transferring surface, the granular material either tends to constantly flow out, thus overflowing the container, or, conversely, to do not flow out at all. Eventually, the dragging effect of the thin powders by the air blow can produce environment pollution.

In WO2005/025828 it is provided to cause the granular material to fall on the transferring surface that is oriented upwards and to recirculate then the excess that did not adhere by collecting the excess from an underlying position with a conveyor belt and with lifting means.

This system results quite complicate due to the fact that the system needs a plurality of moving mechanical parts. Furthermore, since the granular material undergoes to an excessive moving, disgregation of the granules and granulometric separations can occur. In addition, since the granular material is forced to slide on the transferring surface, decompositions in the pattern, alterations in the amount of granular material that is captured by the micro-drops or even pollution of the granular material in excess with humid granules can occur.

EP0927687 provides for lifting selectively powdered decorating material by effect of a vacuum acting through a rotating matrix having permeable zones and for letting the decorating material to fall on the surface to be decorated by interrupting the vacuum.

The decorating material is applied on the transferring surface by causing this surface to slide, in an ascending portion thereof that is oriented downwards, in direct contact with the granular material flowing out a supply hopper. A drawback of EP0927687 is that the scraping of the transferring surface on the granular material may cause alterations in the arrangement and in the thickness of applied powder producing moreover frictions and wears, since the granular material, as a result of the weight thereof and of the friction among the granules, has a certain, although minimal, degree of stiffness and strength. Since this supply system disclosed in EP0927687 can be applied only to an ascending portion that is oriented downwards, in the case that a transferring surface with sliding belt is used, the vacuum chamber has to extend along almost the entire path, which produces a remarkable resistance to the advancing of the belt, frictions and wears. Difficulties also exist in installing effective cleaning means for cleaning the transferring surface (which cleaning means necessarily has to be arranged upstream of the supply hopper), due to the extremely small space available and mainly in the case that a cylindrical transferring surface is used.

In the ceramic industry, pressing technologies have been recently imposed that provide for preparing, upstream of the press, a stratification of material to be pressed the width of which coincides with the maximal width which the press can manage. Generally, this stratification is directly pressed on the preparing belt in a continuous manner or in an indexed manner, or it is transferred in various ways into the moulds. It is thus necessary to arrange the decoration on this stratification, which has therefore a remarkable width.

If it is desired to use the decorating machines of the known type, a plurality of these machines has to be installed that are arranged side by side in order to cover the entire width, or a single machine has to be installed but of remarkable width. In other words, the machine has to have a transferring surface and a series of inkjet heads the width of which is equivalent to the width of the layer.

In both cases remarkable difficulties exist both of economic order and of functional difficulties. Furthermore, since the advancing speed of this large stratification is generally relatively low, in this way these decorating machines are not used at the maximum of the capabilities thereof.

Another limit is that, since various layers of decorating materials have to be applied, as many decorating machines are to be installed as every of the colours to be applied, the decorating machines being arranged in subsequent stations. This implies remarkable investments for the machines to be purchased, large spaces to be occupied that often are not available, costs of maintenance and surveillance.

In the industry of building tiles, made of ceramics, cement or similar, there is the need to produce surfaces having compenetrated decorations, so that the product is not altered by the wear or by aesthetic/functional treatments of surface smoothing, or even for obtaining aesthetic effects which otherwise are not obtainable, or for simplifying the manufacturing cycle. Generally, these tiles are produced by pressing granular mixtures (atomized mixtures) into suitable moulds. The decorations are obtained by distributing coloured powders on the surface of the layer intended to be pressed, which layer can be transferred to the mould of the press in various manners, or can be directly pressed on the preparation belt, in continuous manner or in indexed manner. The decorations can also involve the whole thickness of the tile, in form of more or less shaded veins in order to imitate natural stones, or even in form of geometrical figures having well defined edges.

In the decorations that are formed on the surface layer there is a difficulty in being able to contain said decorating powders in the desired contour, said difficulty being of degree that is proportional to the thickness that is desired to be applied.

This is due to the fact that the powders, being flowable, naturally tend to expand under the action of the gravity force and mainly under the thrust of the pressing surface. Therefore the contour will not be sharp and well defined but it will have a more or less shaded and irregular appearance. This not very defined appearance is further emphasized by the fact that these decorating powders are necessarily applied on the receiving surface by falling from a certain distance.

Some solutions for solving this problem are disclosed in EP0479512, EP0515098 and U.S. Pat. No. 5,736,084, in which there is provided to contain temporarily the powders inside cells that are regularly distributed on the whole surface. Since these cells need to have a remarkable size and obviously have to be delimited by insulating walls, the contour of the pattern that can be obtained is severely conditioned thereby.

In other cases, as for example disclosed in the Italian Patent Application MO98A000055, these containing cells are provided to be conformed with a peripheral size corresponding to the pattern to be delimited. In this case, even though the contour is better defined, the resulting pattern can only be very elementary and rough and, furthermore, the entire apparatus has to be changed in order to vary the pattern.

In IT01251537 it is provided to obtain the dividing diaphragms for the various colours directly in the surface of the tile. For this purpose, a preliminary compression is provided through a mould, which mould forms some raised veins corresponding to the delimitations between the various colours. Also this solution is very limitative, expensive and it actually requires a double pressing operation.

In EP0659526 it is provided to obtain cavities in a base layer, by removing the powder with sucking tubes. The cavities, which are conformed according to the desired pattern, are then filled by the decoration.

Also this solution results very complicate and limitative in the result.

Technologies are known for obtaining decorations that are compenetrated in the support, which technologies provide to form this pattern by means of decorating material that is compacted and crushed in form of irregular tesserae. In this case the colour is well delimited but the obtainable pattern is only a sort of mosaic or "grit-shaped structure". Furthermore, being the decorating material already compacted, incompatibility may occur due to the different firing shrinkage.

Another method for forming decorations that are compenetrated in the surface provides to use colouring materials in liquid solution, which solution has to be applied on the pressed product by means of the traditional decorating systems. A limit of this technology is that the obtainable chromatic range is quite limited and of poor intensity, due to the low chromatic power and the instability of these products at the high firing temperatures. Furthermore, since the soluble salt spreads on the decorated surface by capillary absorption both in depth and laterally, the resulting contour is not well marked but is very shaded. This drawback appears in a very evident manner when the decorated zones are of small amount, for example in the case of narrow veins or thin lines of the order of magnitude of a few mm.

In order to form veins or stratifications passing through the thickness of the tile, systems were adopted in which the powders forming the tile are prepared inside parallelepiped-shaped chambers having the greater walls that are vertically arranged, into which chambers the various layers of colours are caused to fall in succession. An apparatus that is suitable for this purpose is disclosed for example in the Italian Patent Application RE97A000044. This system, as well as requiring a remarkable functional complication, does not enable virtually accurate patterns to be obtained but only veins or spots of variable shapes.

The so called technique of the double pressing is known, mainly used exactly for enabling decorating operations to be performed before the final pressing phase. In this technique, in order to obtain the maximal definition, also silk-screen printing apparatuses or intaglio printing apparatuses are generally used that operate with contact matrices and using decorating material in liquid suspension. Such technology is remarkably complicate and expensive due to the use of two presses. Furthermore, these wet decorating apparatuses generally does not enable a tangible contribution of decorating material, and, in the contact, exert a certain stress on the fragile semi-finished product such as to produce breakages and other drawbacks. For this reason, one is generally forced to act with caution, with consequent delay in the manufacturing cycle. Such caution in moving is required also in the case that "dry" decorating systems without contact are used, since the decorations thus applied on the smooth surface are positioned in a very precarious manner. Furthermore, in this technology, the dry decorations are still more severely subject to the drawbacks of "expansion" beyond the defined contour. This occurs because, being the base layer already solid, during the final pressing the decoration tends still more to expand before being able to compenetrate in the layer. Furthermore, since the semi-finished product resulting from the first pressing necessarily needs to have dimensions slightly smaller than the mould cavity of the definitive pressing, a further drawback shows in the edges, which edges have a poor and irregular pressing, so that some time one is compelled to remove and grind the edges of the finished tile.

In WO0172489 it is provided to arrange powdered decorations on a rotating transferring surface. The decorations are then absorbed on the surface of a layer of granular material during the pressing phase by using the same transferring surface as pressing surface.

This implies a complication of the pressing phase that moreover does not enable the traditional moulds to be used, which moulds have punches entering into the matrix.

Furthermore, the transferring surface, that moreover results extremely stressed, has also to be of remarkable dimensions, having to surround the whole press.

Still again, in the case that it is desired to apply pluralities of decorations in overlapping, since the pressing operation is unique, the various decorations should be previously superimposed on the transferring surface. This is an obstacle that does not enable digital image control systems to be adopted.

In WO9823424 it is provided to lay granular decorating material on the upper smooth surface of a belt or roller, or into cavities of the same surface, and, in a subsequent phase, it is then provided to pass this decorating material over a layer of granular material. When rotating downwards, the decorating material is prevented from falling by containing means consisting of: sliding screens, or rolling belts, or the same layer of granular material that follows the downwards path of the decorating material.

Such a system results first of all remarkably complicate.

The system does not enable the decorating powders to be contained in the contour when the decorating powders are on the smooth transferring surface that is oriented upward.

Furthermore, the version having smooth transferring surface requires further decorating means to be used for depositing these decorating powders on the transferring surface.

An object of the present invention is to improve the above mentioned state of the known art.

BRIEF SUMMARY OF THE INVENTION

In a first aspect of the invention, a method is provided for applying a pattern of granular material on a receiving surface, comprising in sequence:

associating said granular material with a transferring surface together with an aggregating liquid phase and according to a prefiguration of said pattern;

facing said transferring surface carrying said granular material and said liquid phase to said receiving surface in a transferring zone;

characterized in that said method further comprises heating at least one portion of said liquid phase in said transferring zone in order to detach said granular material from said transferring surface and apply said granular material on said receiving surface.

Advantageously, said heating is sudden, it priorly involves the liquid phase facing the transferring surface, which liquid phase rapidly evaporates, and, after being so detached, the granular material retains a significant amount of aggregating liquid phase that is suitable to cause said granular material to adhere to the receiving surface.

In a second aspect of the invention, an apparatus is provided for applying a pattern of granular material on a receiving surface, comprising:

a transferring surface, said transferring surface being movable along a loop path, with a transferring zone, said transferring zone being defined in a portion facing said receiving surface;

applying means arranged upstream of said transferring zone, said applying means being suitable for applying said granular material to said transferring surface together with an aggregating liquid phase and according to a prefiguration of said pattern;

characterized in that said apparatus further comprises heating means suitable for suddenly evaporating in said transferring zone at least one portion of said aggregating liquid phase and causing thus said granular material to detach from said transferring surface and to be applied on said receiving surface.

In a third aspect of the invention, an element is provided for transferring and applying granular material, characterized in that said element comprises a body, said body being internally made of a dielectric material and externally made of an electroconductive layer.

In a fourth aspect of the invention, an element is provided for transferring and applying granular material, characterized in that said element comprises a tubular body, said tubular body being made of a material that is transparent to the thermal radiations.

In an advantageous embodiment of this fourth aspect, the external surface of said tubular body has a high absorption with respect to said thermal radiations.

These four aspects of the invention enable, in the transferring of granular material from a transferring surface to a surface to be decorated, one or more of the following advantages:

a better pattern definition even at high operating speeds;

a better fixing of the decorating granular material on the surface to be decorated;

a safe detaching of the granular material from the transferring surface without involving mechanical means interacting with said surface;

to make more simple and reliable the apparatus;

the reduction of the problems of obstructions and/or wear, even using conventional decorating materials.

In a fifth aspect of the invention, a method is provided for applying a pattern of granular material on a receiving surface, comprising in sequence:

arranging said granular material on a transferring surface;

facing said transferring surface to said receiving surface and applying said pattern of granular material on said receiving surface;

characterized in that said arranging comprises projecting from rotating means said granular material towards said transferring surface and collecting the excess of said granular material that was not kept by said transferring surface by means of said rotating means.

In an advantageous embodiment said arranging further comprises moving said excess towards the lower outlet of a supply container for supplying said granular material, so as to interact with the flow of said granular material exiting said outlet.

In a further embodiment, said moving comprises moving said excess into surface recesses of said rotating means along a path underlying said rotating means.

In a further advantageous embodiment, said arranging further comprises, before said projecting, distributing a liquid on said transferring surface according to a prefiguration of said pattern.

In a further advantageous embodiment, said distributing comprises ejecting said liquid by means of computer controlled inkjet devices.

In a sixth aspect of the invention, an apparatus is provided for applying a pattern of granular material on a receiving surface, comprising:

a movable transferring surface;

distributing means suitable for applying said granular material to said transferring surface;

characterized in that said distributing means comprises rotating means arranged near said transferring surface, said rotating means being suitable for enabling said granular material to be projected towards said transferring surface and being suitable for collecting the excess of said granular material that was not kept by said transferring surface.

In an advantageous embodiment, said rotating means is arranged at least in the lower portion thereof inside a container comprising a first wall lying between said transferring surface and said rotating means and a second wall lying on the side opposite said rotating means.

In a further advantageous embodiment, said distributing means comprises a supply container the lower outlet of which is arranged between said rotating means and said second wall.

In a further advantageous embodiment, the surface of said rotating means is provided with recesses and/or protrusions.

In an advantageous embodiment, distributing means for distributing a liquid is present upstream of said distributing means.

In a further advantageous embodiment, said distributing means for distributing a liquid comprises computer controlled inkjet ejecting devices.

These fifth and sixth aspects of the invention enable, in applying granular material to a receiving surface by means of a transferring surface, one or more of the following advantages:

functional improvements and simplifications;

improving the definition and the accuracy of the obtained pattern;

reducing the frictions and the wears;

improving the control of the amount of applied material;

reducing the amount of recirculating granular material;

reducing the granulometric separations and the stresses on the granular material;

recirculating the granular material in a simple manner and without using specific transporting means;

automatic supplying the granular material in a simple and reliable manner.

In a seventh aspect of the invention, a method is provided for applying a pattern of granular material on a receiving surface, comprising in sequence:

applying with an inkjet apparatus an aggregating liquid according to a prefiguration of said pattern on a transferring surface rotating around at least one axis;

aggregating said granular material to said liquid on said transferring surface through distributing means;

facing said transferring surface carrying said granular material and said liquid phase to said receiving surface in a transferring zone;

moving said granular material towards said receiving surface;

characterized in that, said method further comprises moving reciprocatingly said axis in a direction, said direction being transversal with respect to the advance direction of said receiving surface.

In an eighth aspect of the invention, an apparatus is provided for applying a pattern of material on a receiving surface, said surface being movable in an advance direction, comprising:

a transferring surface, said transferring surface being moving along a loop path around at least one rotation axis;

distributing means suitable for associating said material with said transferring surface;

moving means suitable for moving said material towards said receiving surface;

characterized in that said axis is reciprocatingly translatable in a plane, said plane being parallel to said receiving surface.

These seventh and eighth aspects of the invention enable, when arranging granular or powdered materials on a large surface, one or more of the following advantages:

achieving a pattern that is well defined and controlled in real time by computer means;

improving the aesthetic effects without problems of obstructions and wears, even without contact with the surface to be decorated;

the use of a simple and inexpensive functional machine;

the possibility of superimposing as desired different decorating materials, optionally also with the possibility of causing the decorating materials to deeply compenetrate through a soft mass.

In a ninth aspect of the invention, a method is provided for applying a pattern of granular material on an incoherent receiving surface, comprising in sequence the following phases:

applying a layer of said granular material over said receiving surface, said granular material being arranged according to said pattern;

levelling said layer with respect to said receiving surface.

In an advantageous embodiment of this ninth aspect, it is furthermore provided to repeat said phases one or more times.

In a tenth aspect of the invention, an apparatus is provided for applying a pattern of granular material on a yielding receiving surface, said receiving surface being movable in an advance direction, comprising:

rotating applying means suitable for applying a layer of said granular material;

levelling means suitable for levelling said layer with respect to said receiving surface.

In an advantageous embodiment of this tenth aspect, the apparatus further comprises reciprocatingly translating means cooperating with said rotating applying means.

In an eleventh aspect of the invention, a method is provided for applying a pattern of granular material on a layer of incoherent material, comprising in sequence:

applying a liquid on a transferring surface according to an arrangement prefiguring said pattern;

associating said granular material with said liquid, in order to cause said granular material to adhere to said transferring surface;

placing said granular material into contact with said receiving surface, so as to transfer said granular material from said transferring surface to said receiving surface by maintaining substantially incoherent said layer.

In a twelfth aspect of the invention, an apparatus is provided suitable for applying a pattern of granular material on the receiving surface of a layer of incoherent material, comprising:

a rotating transferring surface;

applying means suitable for disposing a liquid on said transferring surface according to a prefiguration of said pattern;

distributing devices suitable for associating said granular material with said liquid;

characterized in that said rotating transferring surface is arranged in interference with said receiving surface, said interference being such as not to produce any substantial coherence in said incoherent layer.

These ninth, tenth, eleventh and twelfth aspects of the invention enable decorating substances to be arranged on a soft surface of granular material, according to a well defined and stable pattern, and, in advantageous embodiments, with a certain depth of compenetration and with digital control of the pattern in real time.

At least the different aspects of the present invention as defined above can constitute object of independent claims, and also dependent claims.

BRIEF DESCRIPTION OF THE SEVERAL VIEWS OF THE DRAWINGS

The invention will be better understood with the aid of the enclosed drawings, representing exemplifying and non-limitative versions thereof, in which.

DETAILED DESCRIPTION OF THE INVENTION

Figure 1:
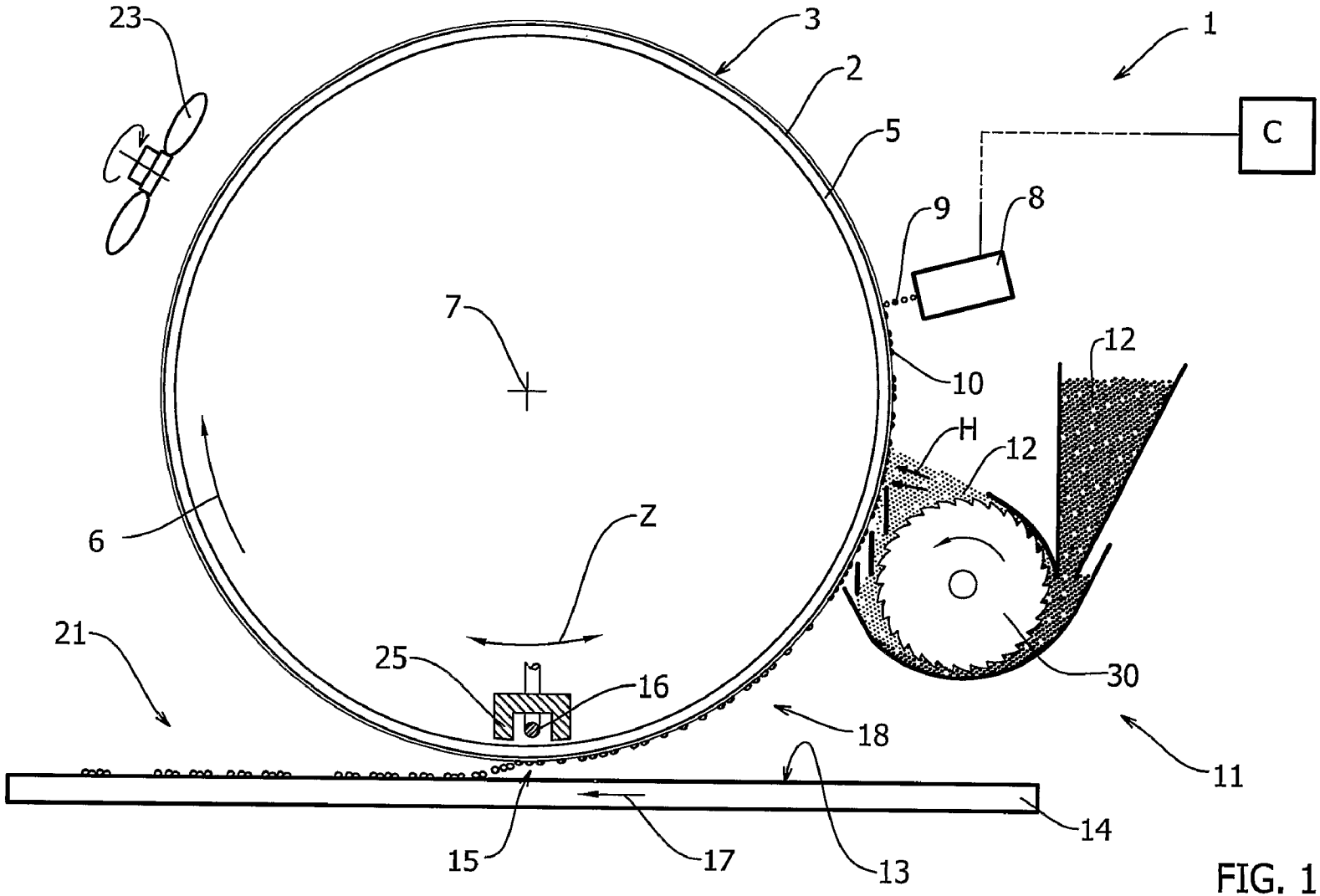
FIG. 1 is a schematic side view of a decorating apparatus according to the invention, with heating means for detaching the decorating material.
Figure 2:
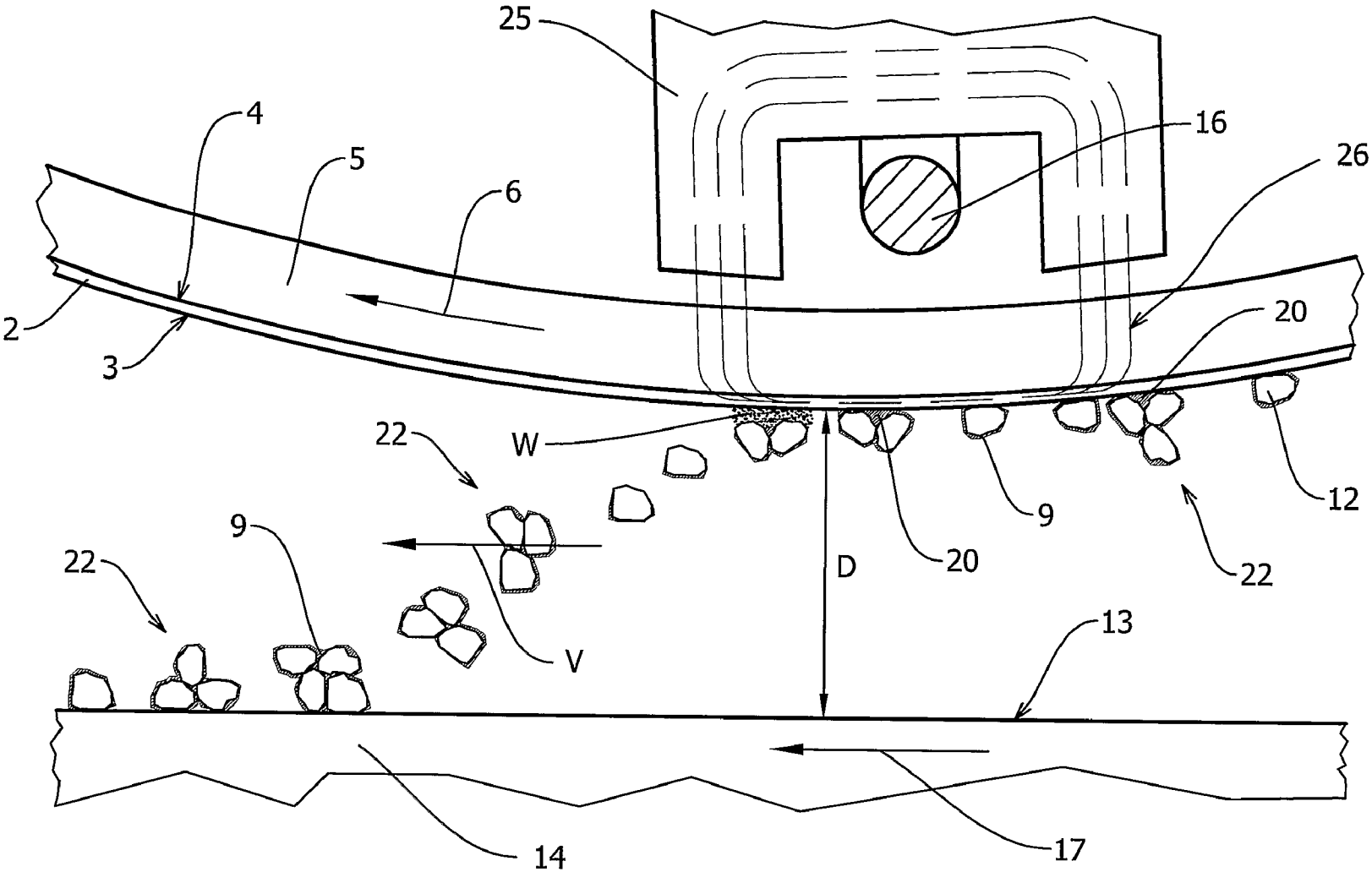
FIG. 2 is a schematic side view of a detail of FIG. 1, highlighting the heating means.
Figure 3:
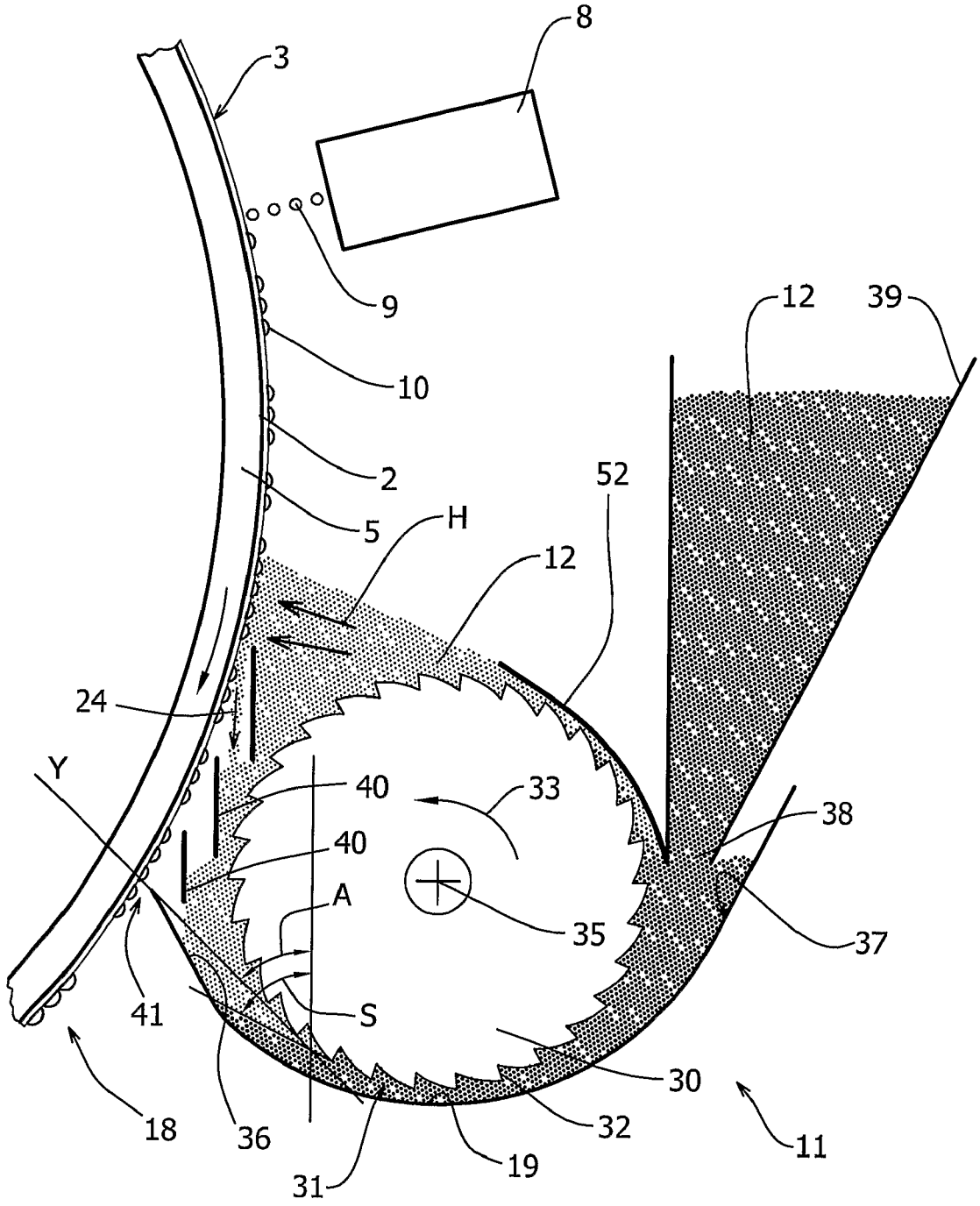
FIG. 3 is a schematic side view of a further detail of FIG. 1, highlighting the distributor of the granular material.

With reference to FIGS. 1, 2 and 3, the apparatus 1 comprises a thin metallic sheet 2, which is ring-closed in a cylindrical tubular shape and the external surface of which constitutes a transferring surface 3. The internal surface 4 of the thin sheet 2 is supported by a tubular body 5, which is made of a material that is electrically and thermally insulating and resistant to temperatures of at least 250° C., preferably at least 350° C.

The tubular body 5, together with the thin sheet 2, can rotate around the axis 7 thereof in the direction of the arrow 6 by means of motorizing means that is not shown.

Outside the transferring surface 3, in a high zone, there is an inkjet device 8 that is actuated by computer means C. More downstream, in a descending portion of the surface 3, said descending portion being downwards directed, a distributing apparatus 11 is arranged that is suitable for projecting the granular material 12 against the surface 3.

A transferring zone 15 is configured in the lower portion of the transferring surface 3 facing the upper surface 13 of a tile 14.

At this transferring zone 15, inside the tubular body 5 in a position near the internal wall thereof, there is a solenoid inductor 16 that is supplied with an electric current of proper frequency and intensity, which solenoid inductor 16 is able to generate an induced current in the sheet 2 and suddenly heating the latter by Joule effect.

The operation of the apparatus 1 is disclosed in the following.

While the transferring surface 3 rotates at uniform speed, the tile 14 advances in the direction 17 in synchronism with the transferring surface 3. The inkjet apparatus ejects on the surface 3 a sequence of micro-drops of water 9 that are arranged according to a prefiguration 10 of the pattern. In the subsequent passage at the distributing means 11 these micro-drops capture the granular material 12 and cause the granular material 12 to adhere to the surface 3. The particles 12 hitting the surface 3 in zones that are devoid of water 9 are rejected and fall into the container 19.

Therefore, in the zone 18 of the surface 3 there is a layer of granular material 12 that is aggregated by the water and arranged according to a prefiguration of the programmed pattern.

Continuing the path near the transferring zone 15, the sheet 2, which is heated to a temperature very higher than the water boiling temperature, for example 240° C. or even higher than 350° C., quickly transfers heat to the thin layer of water 20, which is interposed between the granules 12 and the surface 3, transforming the layer of water 20 in steam W. In this way, a sort of explosion occurs that vigorously detaches the granules 12 and projects the granules 12 toward the receiving surface 13 according to the arrangement of the programmed pattern 10.

It is advantageous that this heating speed is as high as possible, for example, of an order of magnitude with passage from 80° C. to 150° C. in a range of time shorter than 30 ms and, preferably, shorter than 5 ms. In order to achieving that, it is moreover convenient that the zone subjected to the energetic contribution for the heating is as small as possible, by concentrating said zone in the advance direction of the surface 3 in a restricted space. The inductor solenoid 16 will therefore cooperate with suitable concentrating means 25 for concentrating the magnetic flux 26. Since the granules 12 are detached from the surface 3 in a very short time and at the same instant in which the granules 12 are detached they are no more subjected to the heating by conduction, the granules 12 retain a remarkable portion of the original water 9 until the granules 12 impact against the surface 13. This promotes the original arrangement to be maintained as well as a better definition to be obtained since, as highlighted in FIG. 2, the groups of granules 22 can remain mutually coherent even during the travel and, when impacting the receiving surface 13, the granules remain instantaneously blocked on the surface 13. Another important aspect of the invention promoting the best definition is that, in the transferring zone, the granular material 12 is not subjected to interference (doctor blades, scraping means, screen containing means, air jets etc.) that could modify the uniformity of the horizontal speed V in the various granules and cause scattering thereof. Furthermore, in this way the distance D between the surface 3 and the receiving surface 13, when no other obstacles occur, can be minimized and at most also removed. In practice, in order to achieve the maximal definition or for other functional reasons, incoherent surfaces such as those of a layer of powdered material, could be decorated by contact. There is the need to specify that the invention is not limited to transferring without contact only but the invention comprises also the case disclosed above, in which the contact is not the condition determining the transfer by adhesive effect.

Downstream of the transferring zone the sheet 2 returns to the original lower temperature, for example 40-50° C., dispersing the heat in a natural manner, or in a forced manner through fan cooling means 23 or other. In order to control as more as possible this energetic dispersion, and moreover to enable the most rapid heating speed, it is convenient that the sheet 2 is as thin as possible and preferably made of a material having low specific heat and high thermal conductivity. The sheet 2 can have for example a thickness of 5 μm or preferably even less than 1 μm, by adopting a manufacturing method by deposition (electrolytic, vacuum or similar deposition) of an electrically conductive layer outside the tubular body 5. In order to prevent disadvantages due to thermal expansion, the sheet 2 can be made of a material having a low coefficient of expansion, for example INVAR alloy, and/or it can be divided into a plurality of close portions or it may have thin "labyrinth" notches passing through the thickness, for example obtained by cutting with laser beam.

A granular material that is highly suitable for being applied by means of this apparatus is the granular material of the type with non-porous granules, such as for example grits of vitreous materials or sintered mixtures, sands etc. in the various ranges of granulometry from 30 μm to 800 μm, advantageously in a interval of granulometry ranging from 50 μm to 150 μm.

In fact, under these conditions, the water 9 remains arranged in a thin layer around the granule 12 and mainly so as to fill the space 20 between the granule 12 and the surface 3, enabling so the functioning principle of the invention to be practiced as better as possible.

However, other types of materials and granulometries may be treated, for example atomized argillaceous materials, in that case the transferring surface 3 (metallic sheet 2) can conveniently have anti-adhering properties or be externally coated with a material having anti-adhering properties.

According to the cases, other liquids instead of water can be advantageously used.

According to the intended objects, significant sliding frictions are not present in the apparatus 1. The only mechanical stress that the transferring surface 3 has to undergo is the insignificant impact of the micro-drops of water 9 and the impact of the granular material 12 projected against the transferring surface 3. This latter impact however, as already said, can be performed with minimal speed and without producing any sliding or forcing on the surface 3.

Furthermore, it is pointed out that the surface 3 is self-cleaning, i.e. in the normal working the surface 3 has no need of means suitable for removing possible residues of material staying thereon, as explained in the following.

When for example residues of granular material remain attached on a zone of the surface 3, said residues can remain so attached even for different cycles of complete rotation of the surface 3 without that the residues can alter the pattern that is transferred to the receiving surface 13. However, when the dirty zone is over again affected by the pattern and therefore is sprayed by the micro-drops of water, this residual granular material is combined with the material that is projected by the distributor 11 and is then detached in the transferring zone 15.

Such behavior derives from the fact that this detaching system is ineffective when the liquid phase is not present.

This working property is important because in the prior art, on the contrary, possible residues of material, which is not detached from the transferring surface, are always induced to detach at every subsequent passage through the transferring zone 15 producing so-called "phantom images".

However, when these residual powders or granules are precariously attached, the action of the granules 12 projected by the distributor means 11 will detach these residual powders or granules and will place again the latter in cycle without any negative effect. Anyway, when necessary, suitable cleaning means can be provided arranged downstream of the transferring zone.

Another important feature is the easy working even when environmental conditions of high humidity are present. This is a very frequent condition in the field of the ceramic decoration when the glaze in aqueous suspension is applied on the hot surface of the tile.

The application of the granular material 12 aggregated with the liquid phase 9 in the transferring surface 3 is not limited to the example heretofore disclosed but can be performed even in any other known way, such as for example the ways provided in WO2005025828.

Particularly:

instead of the inkjet head 8, an engraved plate (intaglio plate) operating into contact with the surface 3 can be used for applying the liquid phase 9;

instead of the inkjet head 8 and the distributor 11, an engraved plate (intaglio plate) operating into contact with the surface 3 can be used for applying at the same time the granular material and the aggregating liquid phase.

The apparatus for the induction heating is adjustable in the working frequency and the power so that the parameters can be optimized according to the types of granular materials and the working speed. In order to prevent damages for overheating, a safety system will be present suitable for instantaneously interrupting heating in the case that the transferring surface 3 stops or abnormally slows down.

The material forming the support body 5 can be for example plastics, polymeric material, elastomeric material, ceramics or glass. In particular, polymers which are suitable for the electrical and thermal properties may be: polyimide (PI), polyetherimide (PEI), polyetheretherketone (PEEK), aromatic polyketone (PK), polyamide-imide (PAI), polyethersulfone (PES), polyphenylsulfone (PPSU), polysulfone (PSU), polyester (PET), polycarbonate (PC), silicone elastomers, fluoroelastomers.

Figure 6:
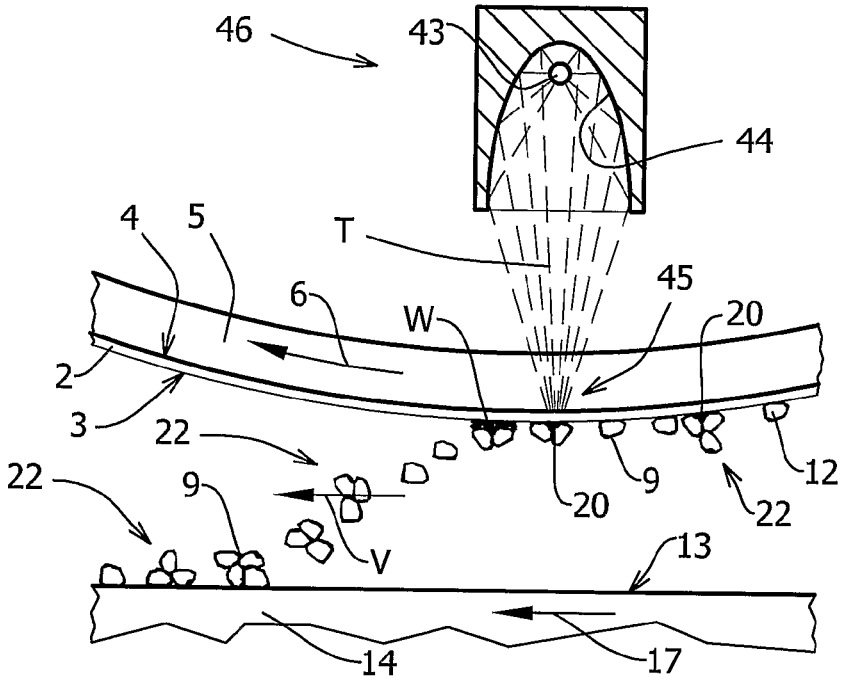
FIG. 6 is a partial and schematic side view of a version of the heating means according to the invention.

In FIG. 6 a version of the invention is shown in which the heating of the sheet 2 is achieved by means of thermal radiation T. The support body 5 is made of a material that is transparent to the infrared rays, while the internal surface 4 of the sheet 2 is absorbent with respect to this radiation. The radiant element 43 cooperates with reflecting and/or refracting means 44, which is suitable for focusing the emission in a thin band 45. In this version the electrical conductivity being not necessary, the sheet 2 can be also of a non-metallic material.

A radiating apparatus 46 suitable for the purpose is for example the LineIR® Heater of the company Research Inc., Minnesota, USA.

The support body 5 may be made of a material that is highly transparent to the infrared rays, selected between the already listed materials. Particularly suitable polymers can be polyetherimide (PEI) and polyethersulfone (PES).

Figure 7:
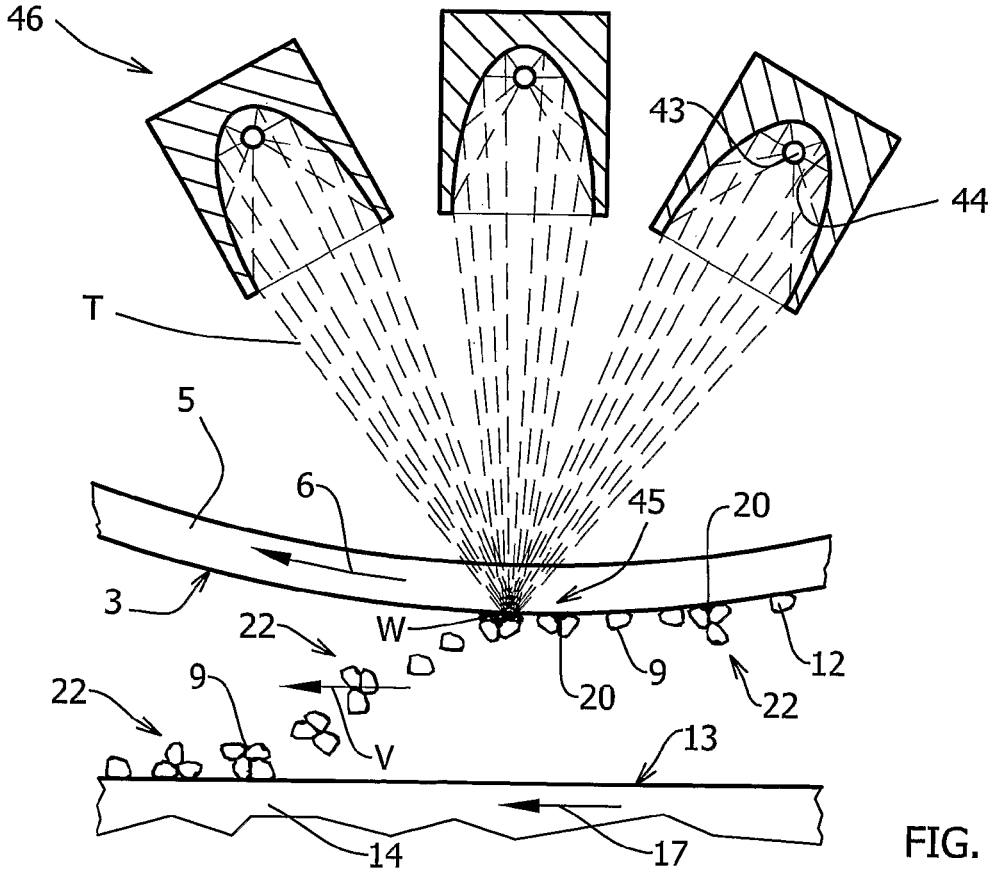
FIG. 7 is a partial and schematic side view of a second version of the heating means according to the invention.

In the second version of FIG. 7 the sheet 2 is not present, consequently the radiation T passing though the transparent support body 5 directly operates on the thin layer of water 20 and possibly on the internal face of the granules 12.

In this case it is convenient that the wavelength of the radiation T is concentrated around the value of 3 μm, corresponding to a frequency of about $10^{14}$ Hz, zone in which the absorption spectrum of the water shows a peak of maximal value (at this frequency, about the 63% of the radiation is absorbed by the water after only 1 μm of penetration).

A radiation having the maximum of energy concentrated in this band of 3 μm is the radiation emitted by a radiant element 43 at about 700° C., temperature that can be easily used in the invention.

In FIG. 7 a plurality of radiating apparatuses 46 are shown converging in a single thin band 45. This arrangement can be useful for adjusting the heating power to the various operating speeds without modifying the temperature of the radiant element 43 (or by modifying the temperature only within acceptable limits). In fact, the variation of this temperature could shift the emission band towards a frequency that is scarcely absorbed by the water or even absorbed by the support 5. Adjusting of the power will be obtained in this manner by keeping at work only the strictly necessary number of radiating apparatuses 46. This arrangement can be useful also in the version of FIG. 6 because, even though the emission at the wavelength of 3 μm is here unnecessary, by varying the temperature of the radiant element 43 the risk however exists of shifting the radiation T towards a frequency that is absorbed by the support 5.

Heating from the inside of the transparent tubular body 5, with or without the absorbent sheet 2, can also be achieved by means of coherent and monochromatic radiation of the scanning laser type, or by means of microwaves, by using the absorbent and transparent types of materials in relation to the used radiation. The apparatus 1 with laser beam, even though is possibly penalized by a higher cost, in certain cases could result advantageous because:

- the apparatus enables the maximal concentration of energy, improving thereby the (temporal and spatial) precision in the detachment;
- the apparatus enables the transmitted power to be easily controlled, in order to adjust the power to the operating speed (and without modifying the wavelength);
- the apparatus enables a lower heating of the support 5. In fact, even though the absorption spectrum of the material of support 5 has absorption bands that are near the laser wavelength, said absorption bands will be absolutely irrelevant since the radiation is monochromatic.

Figures 8, 9:
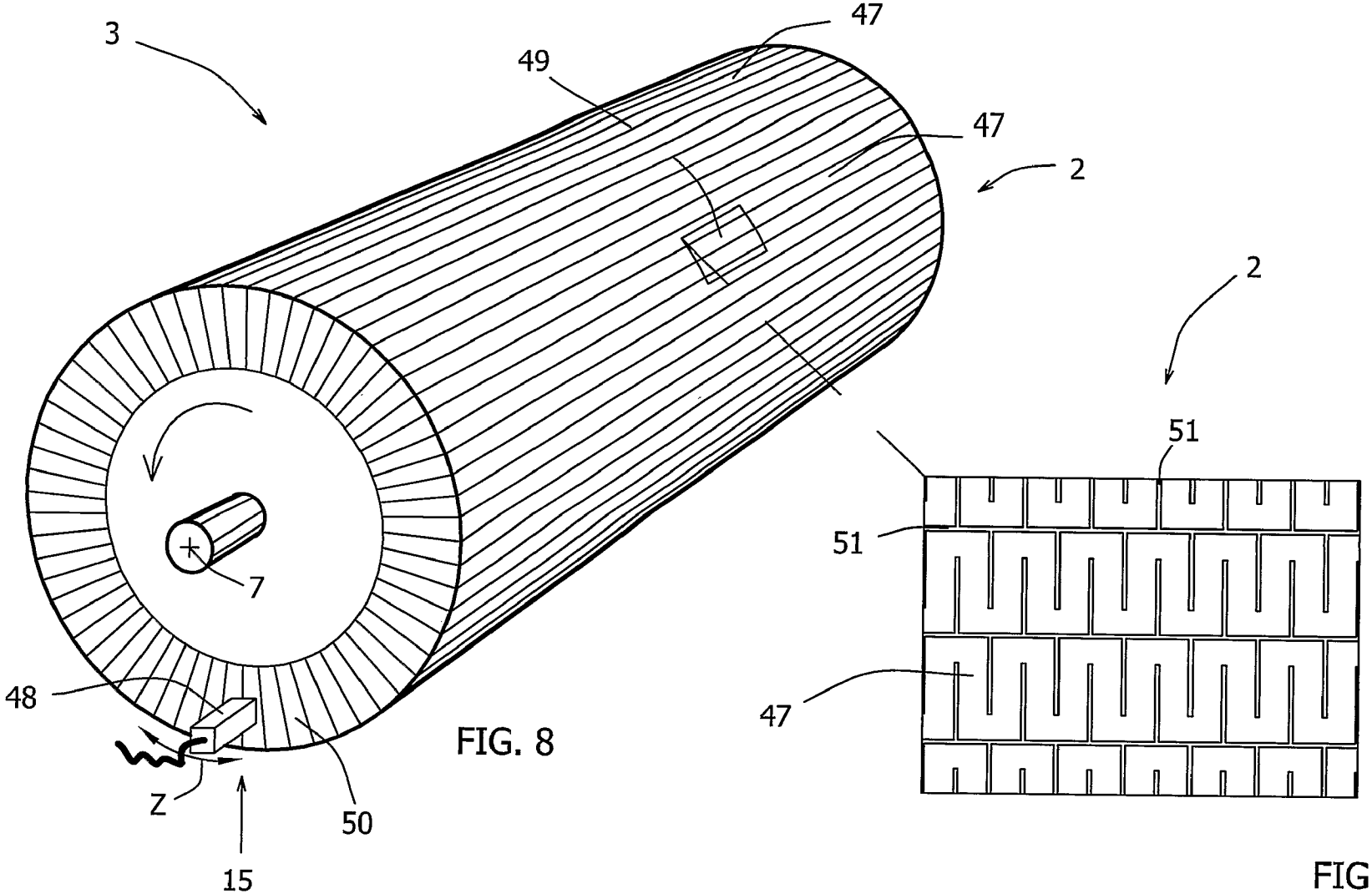
FIG. 8 is a perspective partial view of a third version of the heating means according to the invention.
FIG. 9 is an enlarged view of a detail of FIG. 8.

In the third version shown in FIGS. 8 and 9 the heating of the sheet 2 is achieved by means of Joule effect with direct supply. The sheet 2 is composed of a plurality of narrow strips 47 that are closely arranged but electrically insulated one from another and arranged parallel to the rotation axis 7. These narrow strips 47, by means of a brush contact 48 operating in a collector 50 (or other suitable system), are sequentially subjected to the passage of electric current when transiting in the transferring section 15. In order to prevent drawbacks caused by thermal expansion, these bands 47, as highlighted in FIG. 9, will have advantageously an undulated shape and can be coated by a thin protective layer.

The heating of the surface 3 can however be performed in other ways, which are not shown, such as for example:

- by conduction, through the contact in the internal face 4 of the sheet 2 with a rolling element (roller) or a sliding element that is maintained at a suitable constant temperature;
- by direct heating in the internal face 4 of the sheet 2 with a hot gas. In this case, as moreover in the previous case, the support tubular body 5 for the sheet 2 can not be present;
- through the inductor coil 16 that is arranged outside the tubular body 5, beyond the object 14 to be decorated;

The heating means 16, 46, 48 will be advantageously manually or automatically adjustable in the positioning z parallel to the advance direction 6 of the surface 3 (FIGS. 1, 8), that in order to anticipate or delay the heating action in relation with the operating speed and/or according to other factors, so that the detachment of the granular material 12 can occur in the optimal position, for example in the position of minimal distance D from the receiving surface 13. The advance speed 17 of the surface 13 to be decorated can also be higher or lower with respect to the advance speed of the transferring surface 3, that in order to achieve particular aesthetic effects or to apply more or less amount of granular material 12 on the receiving surface 13.

The sheet 2, in the various embodiments according to the disclosed functional features, can also be integral part of the support 5 and form with the latter a single body without solution of continuity, for example by forming the sheet 2 "in situ" through chemical/physical processing of the support 5 and, in case, by obtaining the thin insulating zones 51 through laser beam processing.

A support 5 complete with sheet 2 of the type shown in FIG. 6, which support 5 is intended for infrared rays heating, can be produced starting from a film of polyetherimide, having a thickness varying between 0.5 and 0.05 mm, preferably between 0.1 and 0.2 mm. The film is cut in the suitable size, is rolled and heat welded so as to form a continuous cylindrical surface. The welding seam is properly ground so that the thickness is uniform. This film could also be obtained already preformed in the cylindrical shape, without welding, by centrifuging the liquid polymer inside a cylindrical rotating die. The external surface of the film 5 is then spray treated with a thermoresistant paint that will form the sheet 2. This elastic paint (for example based on fluoroelastomer), which is thinned in water or other suitable diluent, will have high contents of black carbon and metallic powders so as to have a high absorption with respect to the infrared rays and a good electrical and thermal conductivity. The electrical conductivity is necessary, in order to prevent electrostatical phenomena. The elasticity is required in order to easily bear the thermal expansions and stresses. The paint can be advantageously applied in two or more layers: the first layers being not loaded, and therefore with the maximum of transparency, the subsequent layers of the type disclosed. Advantageously, these layers may be polymerized together in a single treatment so that the layers are better mutually integrated.

The charge of metallic powder and/or black carbon can be advantageously reduced or eliminated, by introducing in the base matrix a certain amount of carbon nanotubes. In fact, these nanotubes, that are marketed for example by Cheap Tubes Inc. (Vermont—USA), have exceptional properties of electrical and thermal conductivity. In this way, with a minimal amount, for example from 3 to 10% in weight, remarkable properties of electrical and thermal conductivity can be achieved, even though the other properties of the base matrix are maintained or improved.

In this base matrix powders and/or fibres can also be dispersed that are selected in a group comprising: black carbon, graphite, metals, metal oxides, ceramics, cermets, minerals, carbides, nitrides, borides, carbon nanotubes.

Practical tests of decoration have been performed on different types of surfaces achieving very satisfying results, both for image quality and operating speed. In particular, it has been detected surprisingly that the decorating material remains well firm and anchored on a vitreous support consisting of an already glazed ceramic tile, even near the peripheral sloping edge.

The thickness of the decoration 57 can be remarkably adjusted by modifying the amount of liquid 9 that is projected by the inkjet apparatus 8 on the transferring surface 3, or by varying the amount of granular material 12 that is projected by the distributor means 11, or by modifying the ratio between the speeds of the transferring surface 3 and the surface 13 to be decorated.

In the following, the distributor means 11 in disclosed in more detail.

With reference to FIGS. 1 and 3, the distributor means 11 comprises a cylindrical rotating means 30 (rotor) that is provided with longitudinal "sawtooth" grooves 31 on the peripheral surface thereof. The walls 32 of the grooves 31 that are suitable for grabbing, i.e. the walls arranged with orientation more near to the radial orientation, are oriented forwards with respect to the direction of rotation 33.

The rotor 30 is arranged inside a container 19, the shape of which follows in a close position the lower contour of the rotor 30 and extends laterally, with respect to the rotation axis 35, with sloping walls 36, 37.

The end portion 38 of an hopper 39 containing the granular material 12 leads into the portion where the walls 32 of the grooves are oriented upwards (on the right-hand side in FIG. 3), at a middle height with respect to the rotor 30 and in the space between this rotor 30 and the sloping wall 37. In the opposite side, the rotor 30 is positioned at some millimeters of distance from the transferring surface 3 in a descending portion that is oriented downwards. Also the upper edge of the wall 36 is arranged in a position near the surface 3, but without touching the latter. The rotor 30 is provided with such a rotation speed that by centrifugal force the granular material 12, which is raised inside the grooves 31, is projected in a direction H against the surface 3.

As already explained previously, having found the micro-drops of water 9, 10 the material 12 adheres to the surface 3 and proceeds on said surface 3 overcoming the wall 36 without being hampered. The material 12 that was not captured by the micro-drops of water 9, 10 is rejected and gives rise to a falling flow 24 that is collected by the wall 36. Upstream of the wall 36 safety screens 40 are present in order to prevent any possible leakage of particles from the slot 41 between the wall 36 and the transferring surface 3. The granular material 12 so collected in the bottom of the container 19 is dragged into the grooves 31. Thus, a recirculation of granular material 12 begins, which material 12 in the high portion of the rotating means 30 is moved away from the outlet 38 of the hopper, while on the contrary, in the low portion is moved closer to the outlet 38. Since the flow rate of granular material is potentially higher in the low portion of the rotor 30, as the cavities of the grooves 31 can be fully filled here, the granular material 12 cannot overflow from the container 19 due to overcoming of the wall 36. It is however important that the angle A, formed by the vertical with the line Y joining the upper edge of the wall 36 and the lower point of tangency in the rotor 30, is smaller than the slope angle S that is due to the sliding friction of the granular material 12. Thus a balance condition is established in the motion of the granular material 12, whereby, the granular material 12 will flow out of the hopper 39 only when near the outlet 38 the obstruction effect will decrease and the sole amount of granular material 12 that is removed by the transferring surface 3 will be replaced.

Figure 24:
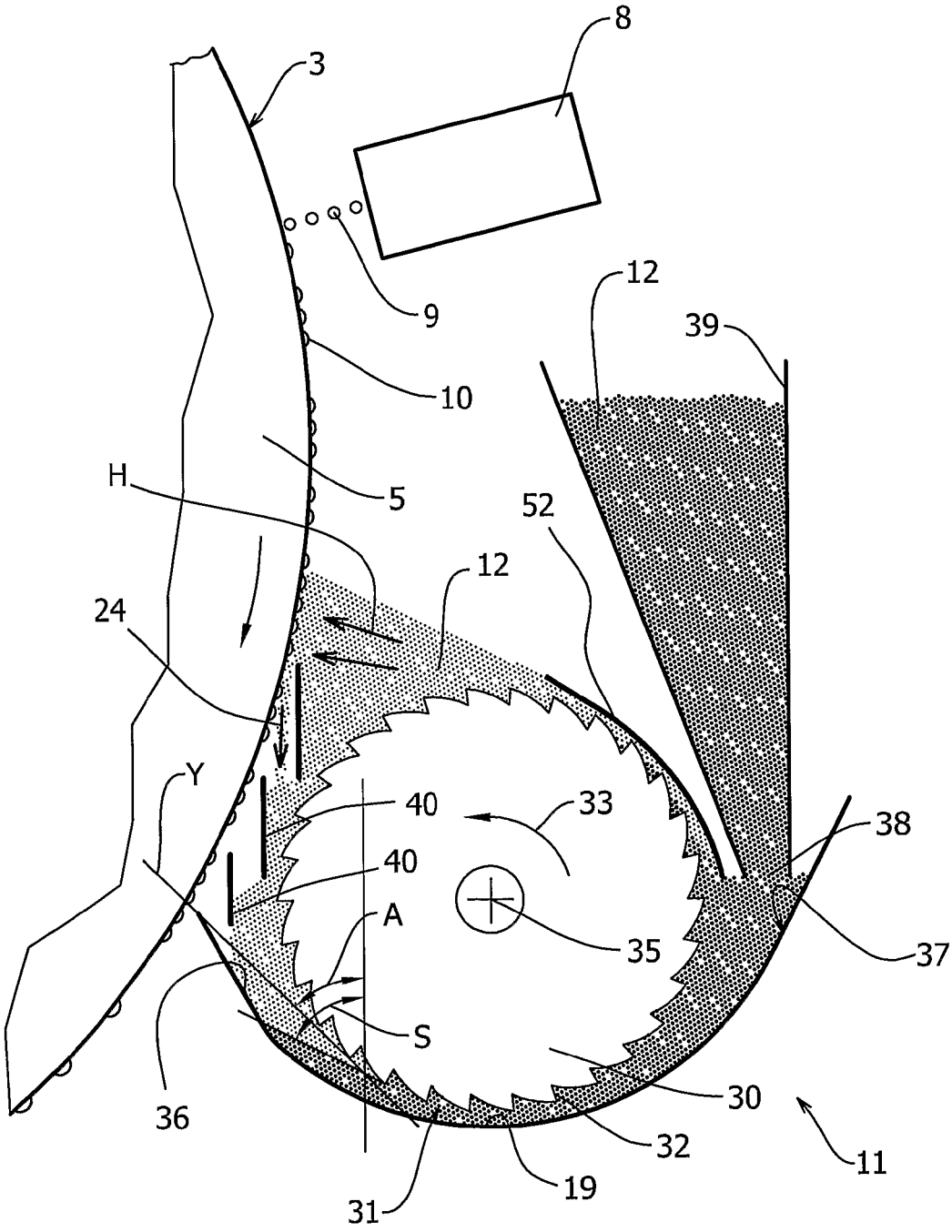
FIG. 24 is a schematic side view of a distributor like the distributor in FIG. 3 highlighting the use thereof in a further different context.

In FIGS. 3 and 24 the rotor 30 cooperates in the high portion thereof, which is oriented towards the outlet 38, with a shield 52 that is arranged in a wrapping and close manner but without contact. In this way, the effect of upwards projecting the material 12 is made more effective, however without exerting excessive stresses on the material 12 and the rotor 30, since the interposed material 12 is in a "fluid" state. In order to prevent effectively the leakage of granular material 12, a plurality of shields 40 are vertically cascaded and made as close as possible with the upper edge to the surface 3.

Figure 23:
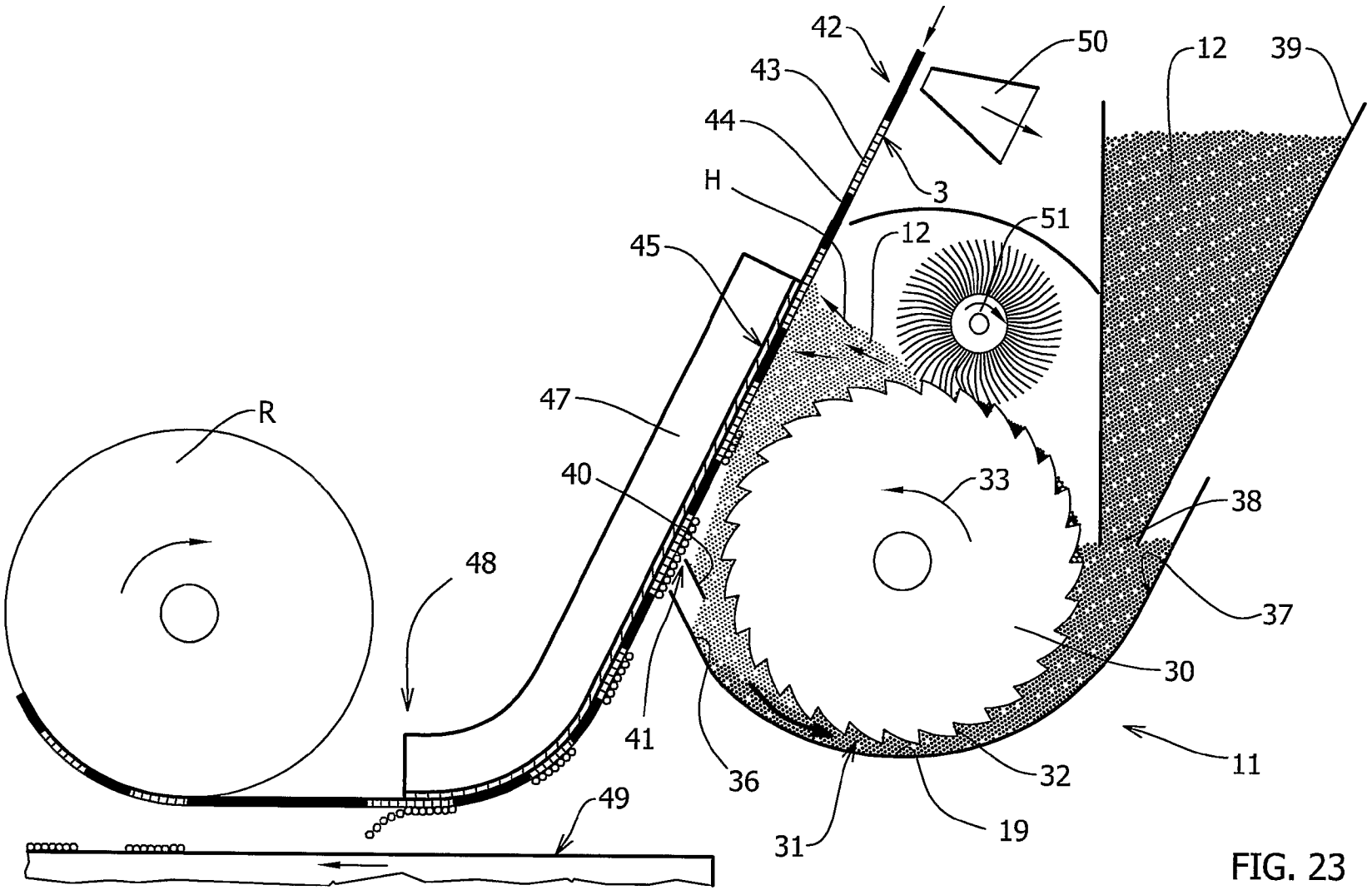
FIG. 23 is a schematic side view of a different embodiment of the distributor of FIG. 3, used in a further different context.

In FIG. 23 the rotating means 30 is in contact in the high portion thereof with a cylindrical brush 86 rotating in opposing direction and with a peripheral speed that is higher than the speed of the rotor 30. In this case the rotating means 30 can rotate more slowly, without causing per se the material to be moved away by centrifugal effect, while the propelling effect for projecting the granular material 12 is assigned to the brush 86. This configuration is useful, for example, when it is desired to vary the metering of the granular material 12, by varying the speed of the rotating means 30, without affecting the projecting speed.

The Figures schematically highlight the state of the granular material 12, which is shown by means of a darker shading where the various granules are in contact mutually and it is shown by means of a lighter shading where the various granules are spread in the air, in a suspended state with substantial separation of the granules from each other. This spread state, together with the fact that the material is projected on the surface 3 with an almost orthogonal direction H, prevents distortions on the granules already captured by the surface 3.

This distributor 11 offers furthermore a series of important advantages. First of all the distributor 11 is simple, since it does not require complex transporting systems for the recirculation, belts, elevators etc. The distributor 11 does not have mechanical parts mutually sliding. The distributor 11 does not have mechanical parts intended for engaging in rolling manner (belts and rollers), which parts are very problematic to be managed in presence of granular material, because, when the granular material is entrapped between the engaging surfaces, the granular material causes severe damages and troubles. The distributor 11 works optimally at any speed of the surface 3, i.e., the peripheral speed of the rotating means 30 does not require to be synchronous with the peripheral speed of the surface 3. Thus, it is possible to modify the amount of granular material 12 that is laid down on the surface 13 to be decorated without acting on other parameters, by varying the speed of the rotating means 30 or even the shape of the grooves 31 and the capacity thereof. The distributor 11 does not exert contact with the transferring surface 3. The distributor 11 does not contaminate the environment, having no blowing means. The distributor 11 does not produce distortion on the granular material 12. The distributor 11 is self-supplying and does not need devices for controlling the level of the granular material 12, or for supplying the granular material 12.

It is noted that at any rotating turn of the rotating means 30, the granular material contained in the grooves 31 is fully unloaded and then reloaded, which prevents the granular material from remaining stagnant in active zones and assures a uniform working during the time.

Figure 4:
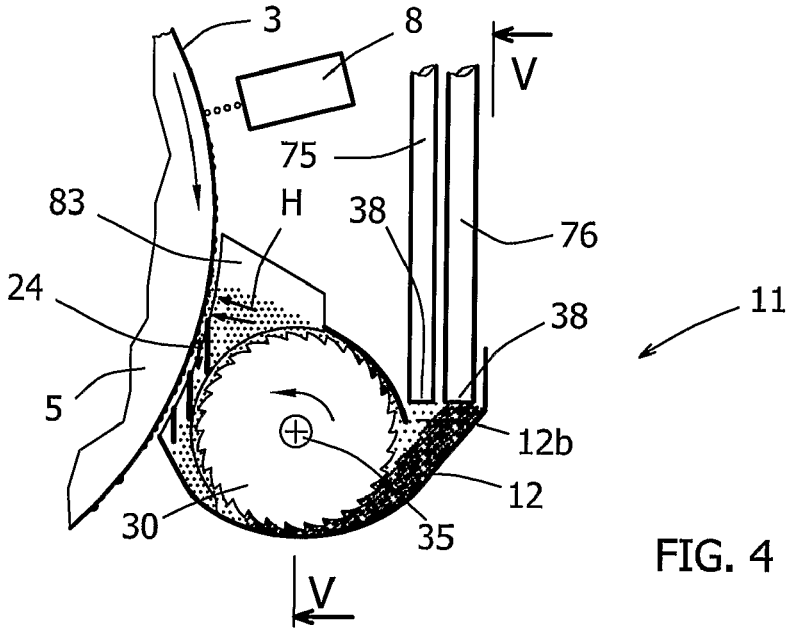
FIG. 4 is a view of a detail like the detail in FIG. 3 in a different configuration for simultaneously applying different types of granular materials.
Figure 5:
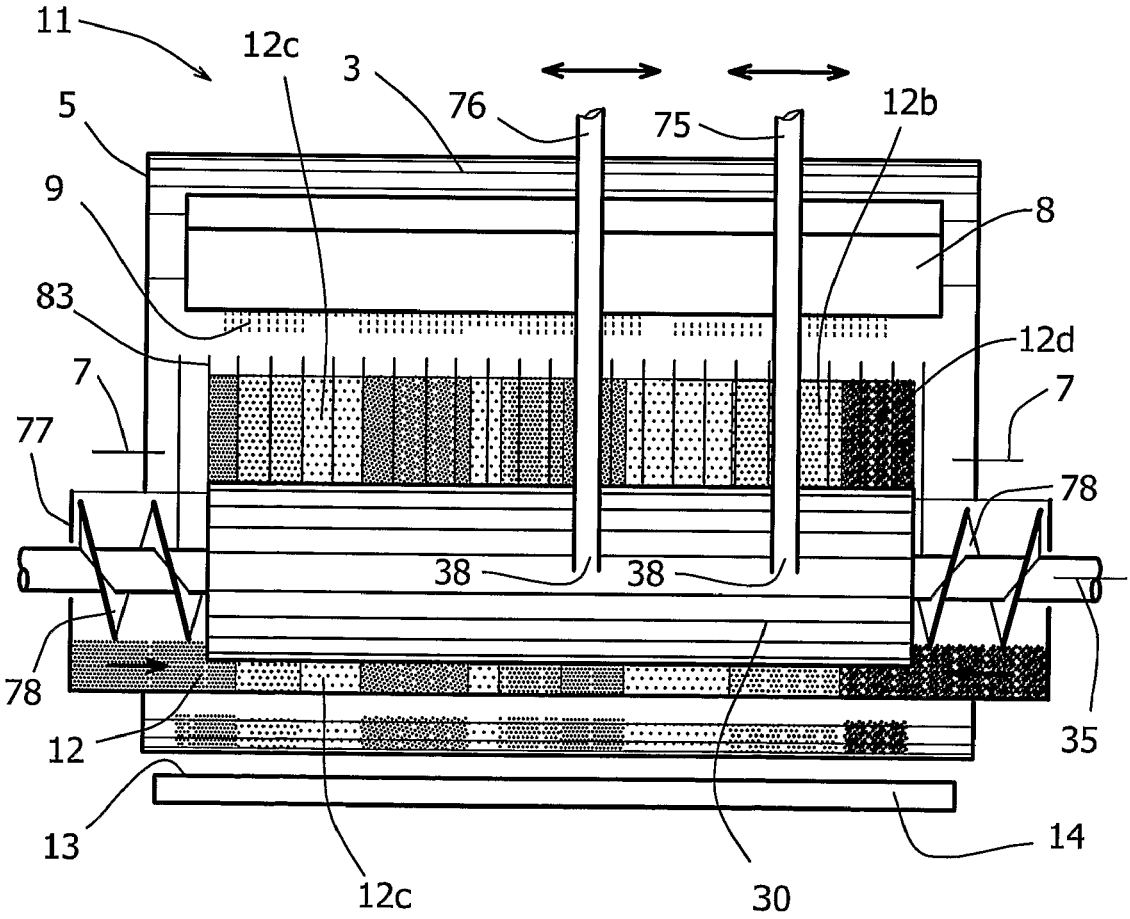
FIG. 5 is the V-V section of FIG. 4.

The distributor 11 moves in the recirculation a minimal amount of material 12 (the amount inside the grooves), which amount is then renewed in short time, so that prolonged stresses on the granules, granulometric separation, etc. are prevented. This feature is important also because it enables, as shown in FIGS. 4 and 5, various granular materials 12, 12*b*, 12*c* to be simultaneously used by using a distinct supply by means of distinct ducts 75, 76. This possibility is also enabled by that in this distributor 11 a minimal remixing is present in transversal direction and therefore the various colours 12, 12*b*, 12*c* can remain for a long time substantially separated.

Furthermore, as already said, the amount of granular material in circulation being minimal, a same zone can also be supplied with various colours in rapid succession by laterally moving said ducts 75, 76 or by varying the flow rate thereof, so as to obtain aesthetic effects that are impossible to be obtained in other way.

In order that the transversal remixing of the various granular materials 12, 12*b*, 12*c*, 12*d*, is prevented more effectively, thin dividing diaphragms 83 can be used that are arranged between said rotor 30 and said transferring surface 3 according to a plane that is normal to the rotation axis 35 of the rotor 30.

In order to laterally contain the granular material 12 without the aid of sliding sealing means between the axis 35 of the rotor 30 and the side wall 77 of the container 19, and in order to prevent the material 12 from excessively accumulating in the zones that are lateral to the rotor 30, the axis 35 is conveniently provided with mutually opposed spiral means 78, which spiral means 78 is suitable for conveying the material 12 to the rotor 30.

Figure 21:
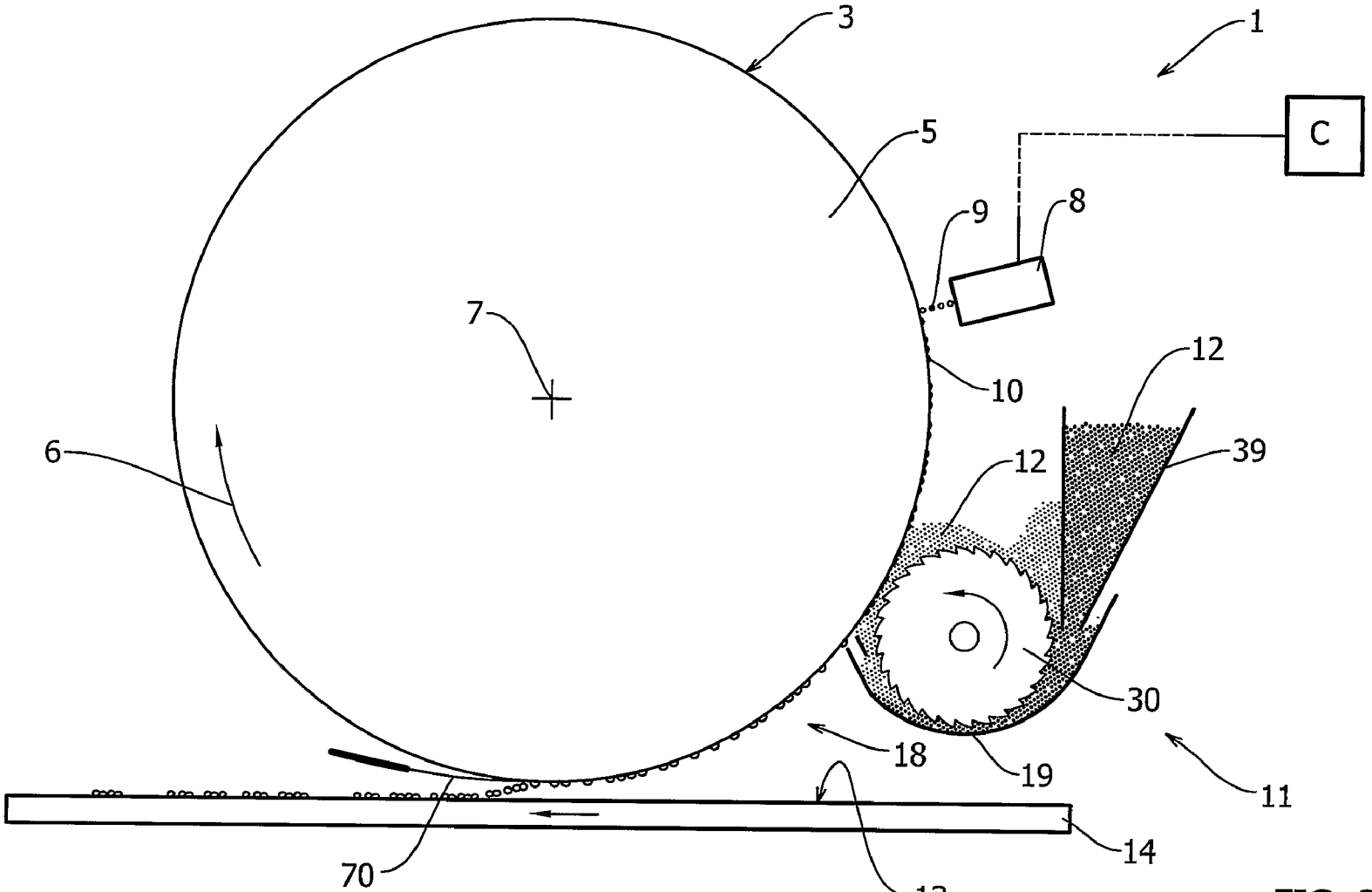
FIG. 21 is a schematic side view of an apparatus according to the invention, highlighting the use of the distributor of FIG. 3 in a different context.
Figure 22:
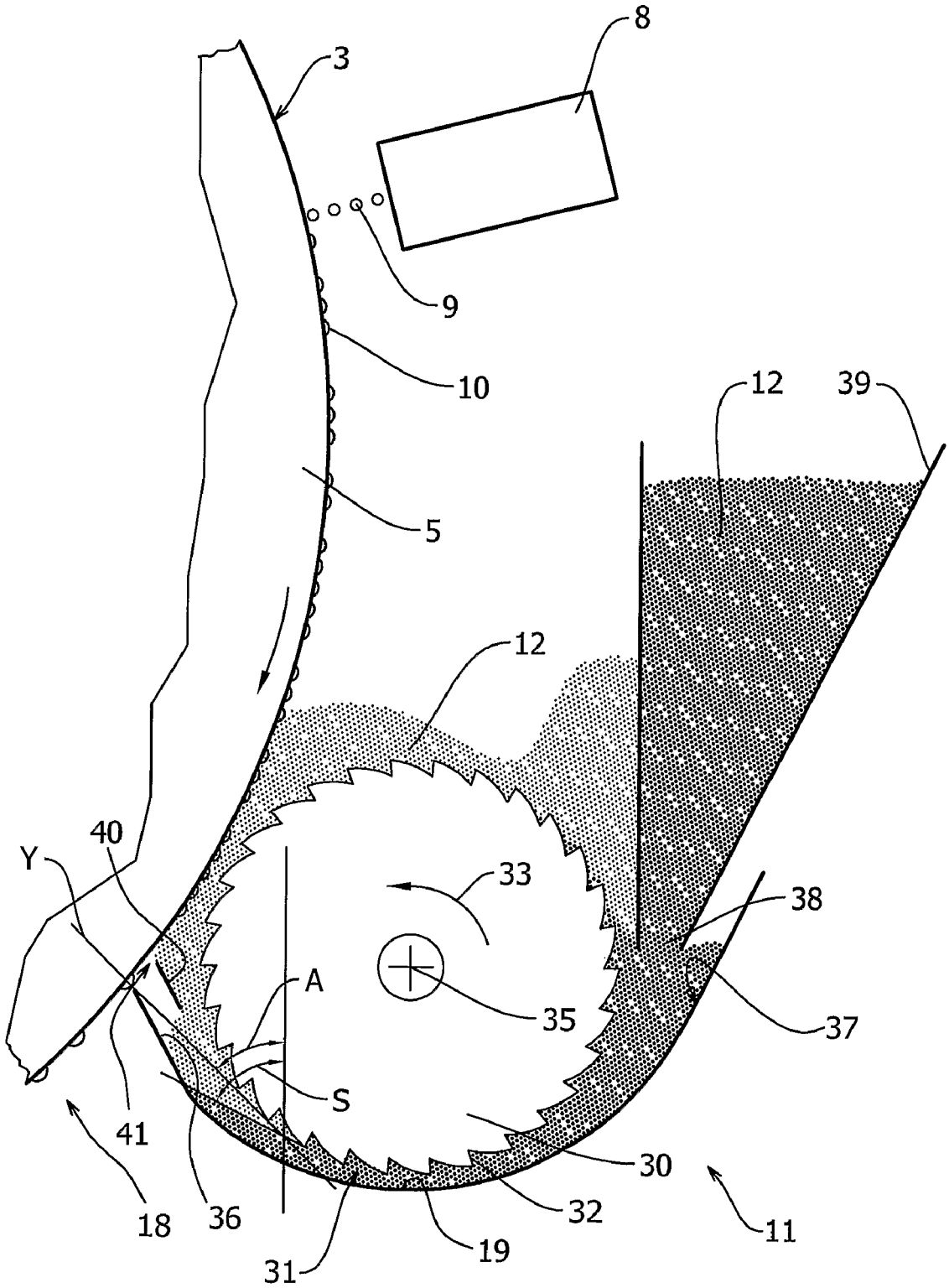
FIG. 22 is a schematic side view of the distributor of FIG. 21.

The distributor 11 can also be applied in the context of decorating machines of different type, such as for example shown in FIGS. 21, 22 and 23.

With reference to FIGS. 21 and 22 the apparatus 1 comprises a cylindrical body 5 the external smooth surface of which constitutes a transferring surface 3.

The cylinder 5 is rotating around the axis 7 thereof in direction of the arrow 6 by means of motorizing means that is not shown.

Outside the transferring surface 3, in a high zone, there is an inkjet apparatus 8 that is controlled by computer means C, which apparatus is able to eject on the surface 3 a sequence of micro-drops of water 9 that are arranged according to a programmed pattern 10. More downstream, in a descending portion of the surface 3 that is oriented downwards, a distributor apparatus 11 of granular material 12 is arranged, which granular material 12 adheres to the surface 3 at the pattern 10 that is formed by the micro-drops of water 9. The particles 12, hitting the surface 3 in zones that are devoid of water 9, are rejected and fall into the container 19 returning directly in cycle.

Thus, in the zone 18 of the surface 3 there is a layer of granular material 12 that is aggregated by the water and is arranged according to the programmed pattern.

In the lower portion of the transferring surface 3 facing the upper surface 13 of a tile 14, there is a transferring means suitable for causing the granular material 12 to move from the transferring surface 3 to the receiving surface 13. In FIG. 21, merely by way of example, this transferring means is shown as scraping means 70.

In FIG. 23 the transferring surface is composed of a flexible, ring-closed diaphragm 42, which is provided with permeable zones 43 and impermeable zones 44 and which is slidingly movable, through a driving roller R, on a permeable supporting wall 45 on the back of which inside a chamber 47 a slight vacuum is maintained. The chamber 47 extends over a short length up to a lower position 48 facing the surface to be decorated 49. The distributing apparatus 11 works in a manner that is the same as the distributing apparatus already disclosed in the example of FIGS. 21 and 22, and therefore, at the permeable zones 43 the granular material adheres to the diaphragm 42 and is transferred to the receiving surface 49 where the granular material falls by gravity as a consequence of the interruption of the vacuum.

The application without contact of the granular material 12 in the descending portion of the diaphragm 42 enables the drawbacks already highlighted in relation with EP0927687 to be overcome. It is furthermore possible to easily arrange cleaning means 50 in the high portion of the diaphragm 42, even in the case that the diaphragm 42 is of rigid type and cylinder-shaped. Furthermore, minimizing the vacuum chamber 47 offers the advantage that a lower flow rate is required of depressurized air, and, consequently it also offers the advantage of a lower dispersion of thin granules sucked through the diaphragm 42.

Figure 25:
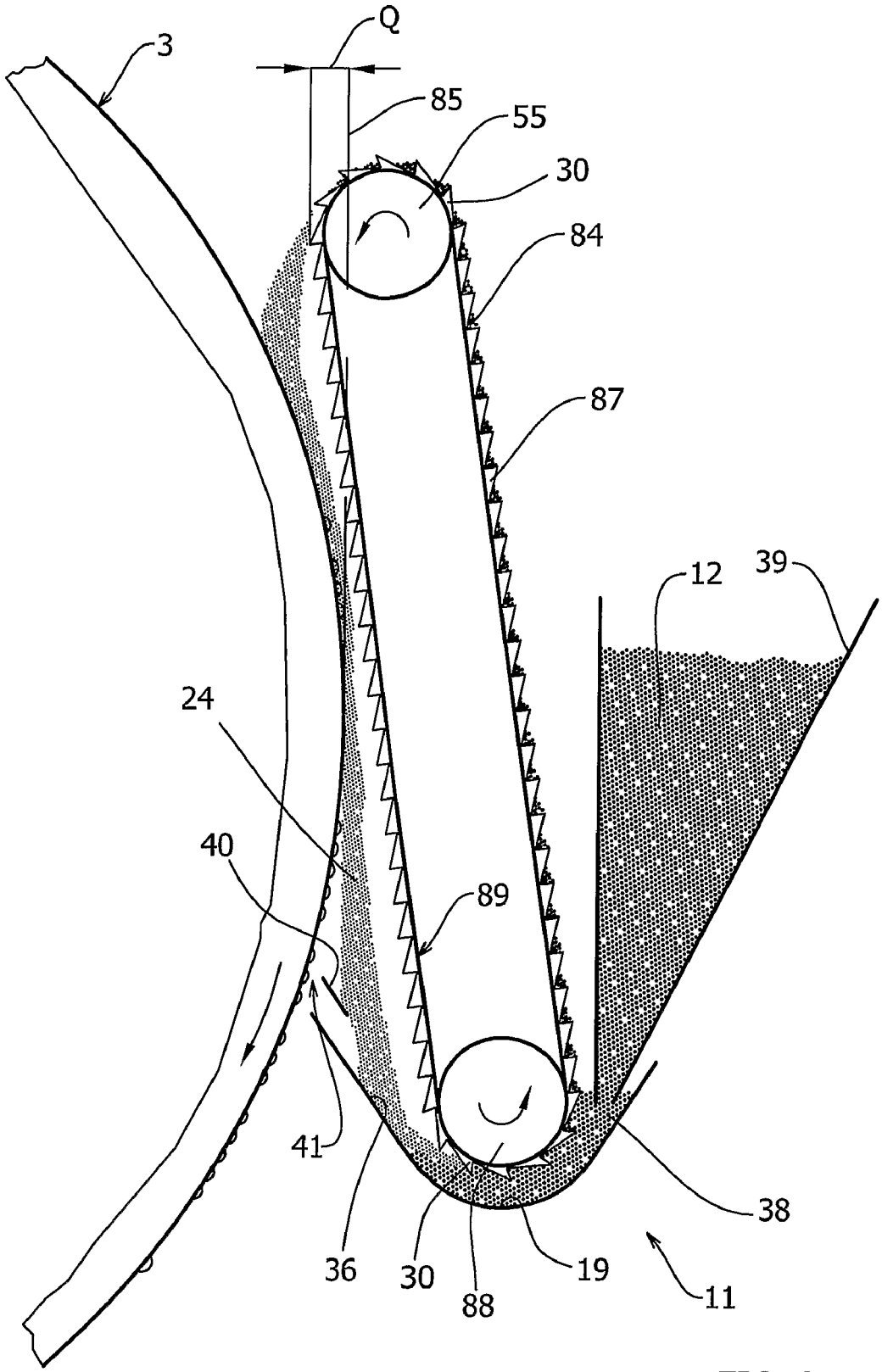
FIG. 25 is a schematic side view of a further different embodiment of the distributor of FIG. 22.

FIG. 25 shows a further version, in which the rotating means is an endless conveyor belt 87 that is supported by two rollers 55, 88, at least one of which is motorized by means that is not shown. The belt 87, which is arranged in a almost vertical position with a certain slope towards the transferring surface 3, has the external surface with cavities 84 that are suitable for lifting the granular material 12 and extends in height from a low position in which the transferring surface 3 is directed downwards, to a high position in which the transferring surface 3 is directed upwards. In this case the granular material 12 is projected on the transferring surface 3 by simple fall under the effect of the gravity.

The contact of the granular material 12 on the surface 3 is promoted by that the upper portion of the belt 87 exceeds for a certain height Q the vertical 85 tangent to the transferring surface, and furthermore, also by that the granular material 12 in the starting falling phase, by sliding on the sloping surface of the cavities 84, receives a certain push in direction of the surface 3. The working of the recirculation in the low portion is similar to the working already disclosed in the other examples.

In this version with elevator belt 87, suitable precautions will be necessary for preventing entrapments of granular material 12 between the surface of the lower roller 88 and the internal surface 89 of the belt 87, for example, by providing that the roller 88 is composed of narrow transversal elements that are distributed on the circumference, like a cylindrical cage.

In the zone adjacent the distributor 11, the transferring surface 3 is always shown with the motion oriented downwards, however the machine can likewise works also with reverse motion of the surface 3, i.e. upwards.

Different configurations of the apparatus 1 are now disclosed.

Figure 10:
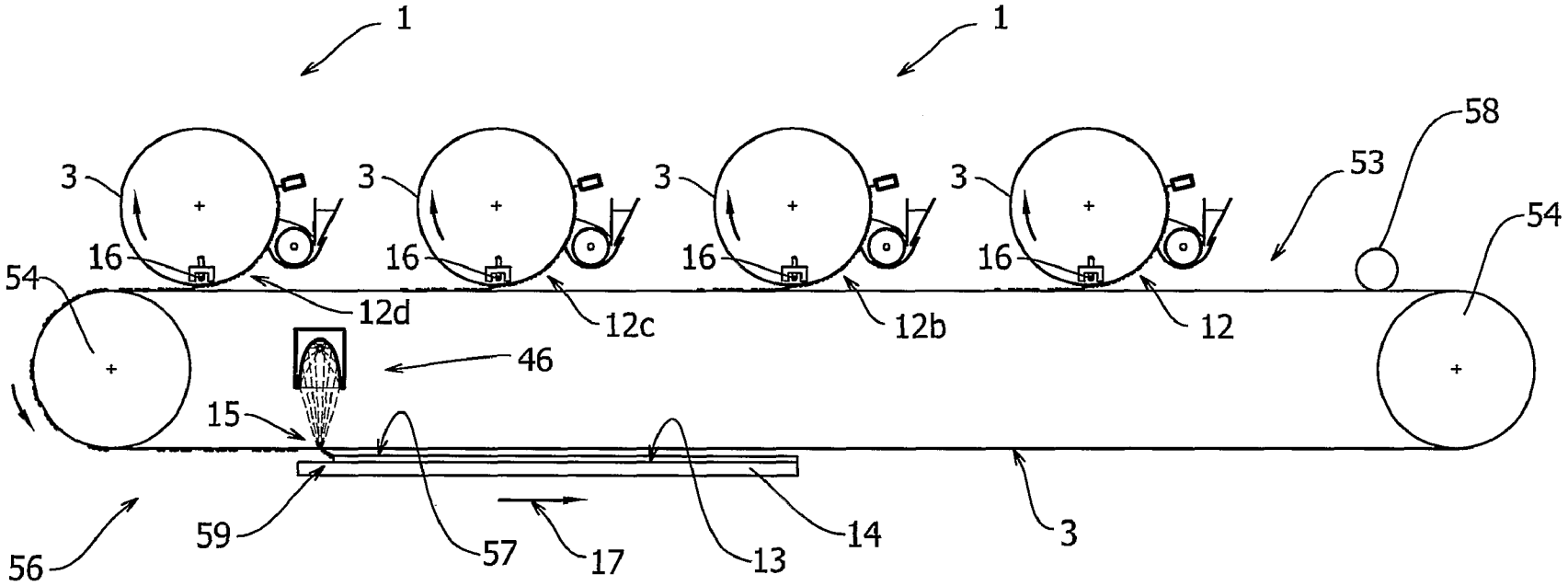
FIG. 10 is a schematic side view of a fourth version of the apparatus according to the invention suitable for applying simultaneously more types of granular material.

In FIG. 10, the transferring surface 3 is composed of a endless belt 53, tensioned and driven by rollers 54. The belt 53 is of a material that is transparent to the infrared rays and in the lower branch cooperates with a radiating apparatus 46 of the type already disclosed. In the upper branch of the belt 53 four applying apparatuses 1*c* are successively arranged, each of which applies a thin layer 12, 12*b*, 12*c*, 12*d* of granular material of various colours, thus forming a prefiguration of the pattern 56 with the various colours that are overlapped with each other or in close sequence.

In the transferring zone 15 these layers 12, 12*b*, 12*c*, 12*d* are simultaneously transferred by mixing and forming so a decorative layer 57 with various chromatic gradations, depending on the proportion of the four different colours.

Since the surface 13 to be decorated may advance with speed also very lower than the speed of the transferring surface 3, a thick layer 57 of decorating material can be obtained the chromatic properties of which are substantially constant within the full thickness. A decoration 57 of this type can undergo remarkable surface removals by wear or polishing, without that can cause a remarkable variation of the aesthetic effect or the functional properties.

In the apparatus of FIG. 10 also the applying apparatuses 1*c* are of the type according to the invention, however the applying apparatuses 1*c* can also be of any other type, even without computer control and in any number.

In order to cause the decorating layers to adhere better, mainly when the decorating layers are exposed downwards in the lower branch of the belt 53, it is provided to slightly wet the transferring surface 3 in a position that is upstream of the applying apparatuses 1*c*, by means of suitable roller means or sponge means 58, or with another device working even without contact.

The combination of FIG. 10, i.e. the coupling of the detaching system by rapid heating and the application of different granular materials remixed in a thick stratification, is particularly ingenious. In fact, the front line 59, where the thick layer 57 progressively develops, remains well defined since the wet granules immediately fix to each other without any possibility of sliding. A current problem of the prior art is thus resolved, where, as for example disclosed in WO0172489, in order to prevent the granules from sliding in the front line of the thick layer, the thick layer is formed in a vertical advance direction and then is diverted in horizontal direction. Moreover, for the same purpose, the use is also provided of a dense array of transversal containing lamellae accompanying the thick layer up to the horizontal position. These prior art solutions are complex, and in any way, mainly in the case of the containing lamellae, produce alterations and discontinuities in the formed layer.

With reference to FIGS. 11 to 15, two distributors 11, 11*b* are coupled with a transferring surface 3 of the type disclosed in FIGS. 6 and 7, the two distributors 11, 11*b* being specularly arranged with respect to the vertical plane passing through the rotation axis 7 and the inkjet head 8 is arranged at the top with equidistance from the two distributors 11, 11*b*. The apparatus 1 is arranged above the surface 13 of a layer 61 to be decorated, with axis 7 parallel to the advance direction 62 of the surface 13.

The apparatus 1 is supported by translating means, which is not shown, suitable for translating reciprocatingly the apparatus 1 along the direction 63, 67 between two extreme transversal positions P1, P2 of the surface 13.

An identical apparatus 1*b* is associated with the apparatus 1 and precedes the latter along the translating direction 63. The so formed complex K comprises therefore four distributors 11, 11*b*, 11*c*, 11*d* each of which can be activated independently so as to project against the transferring surface 3 the granular material contained in the corresponding supply hopper 39. Each of the four hoppers 39 contains a differently coloured material 12, 12*b*, 12*c*, 12*d*.

Figure 11:
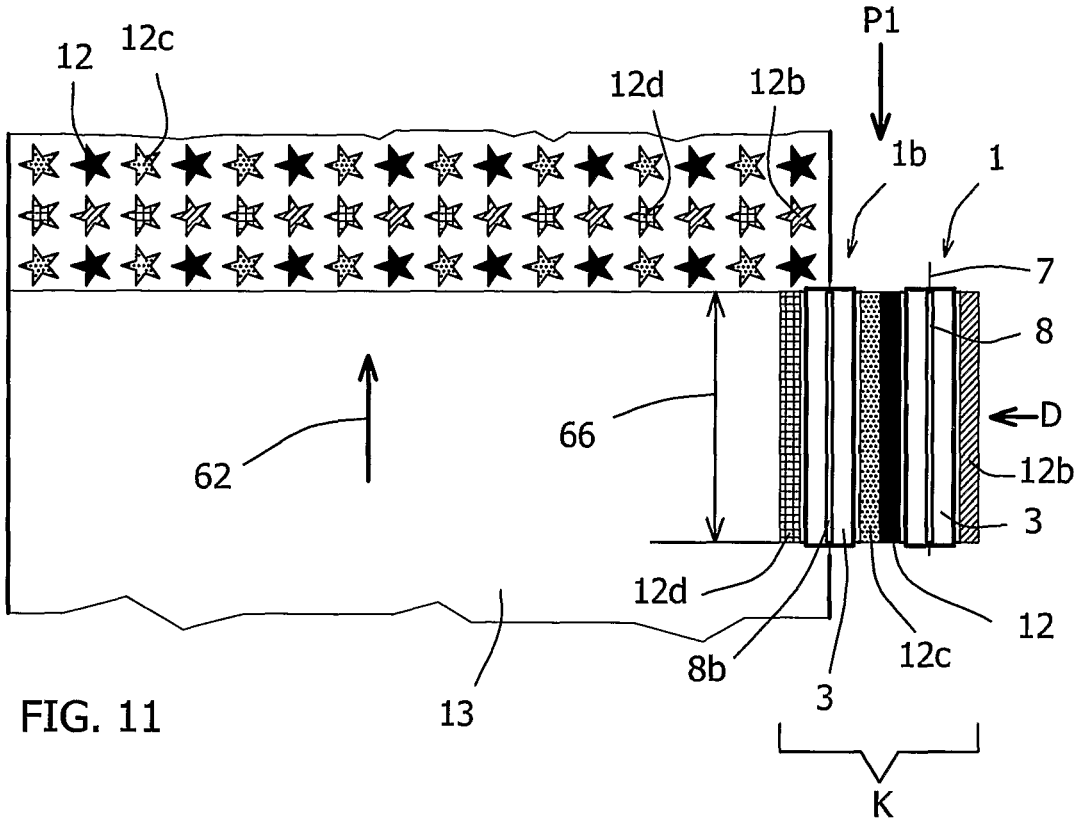
FIGS. 11, 12, 13 and 14 are schematic plan views of a fifth version of the apparatus according to the invention, suitable for applying in subsequent phases more granular materials in a same station.

In a first phase shown in FIG. 11, the surface 13 is stationary since the surface 13 has just completed an advancing step of an amount 66 along the direction 62, said amount 66 corresponding to the width of the apparatus 1 (or even greater in the case that the continuity of the pattern is not necessary), the complex K is in the extreme position P1 and is ready for starting translation 63.

Figure 12:
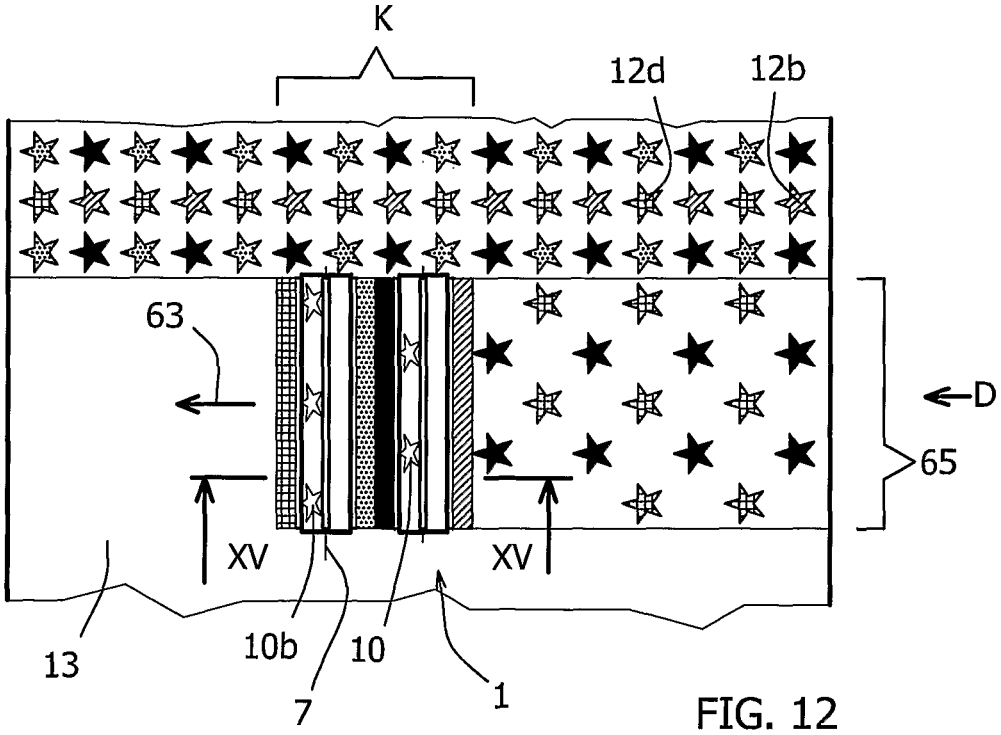
Figure 13:
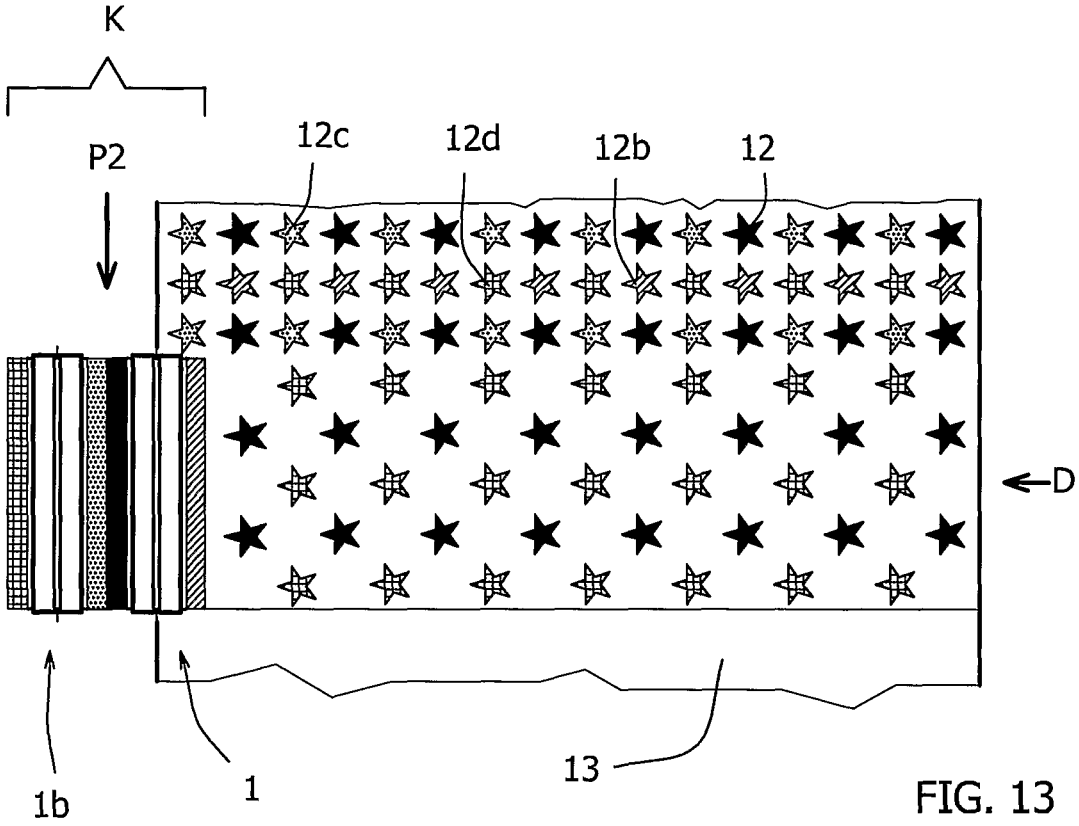
Figure 14:
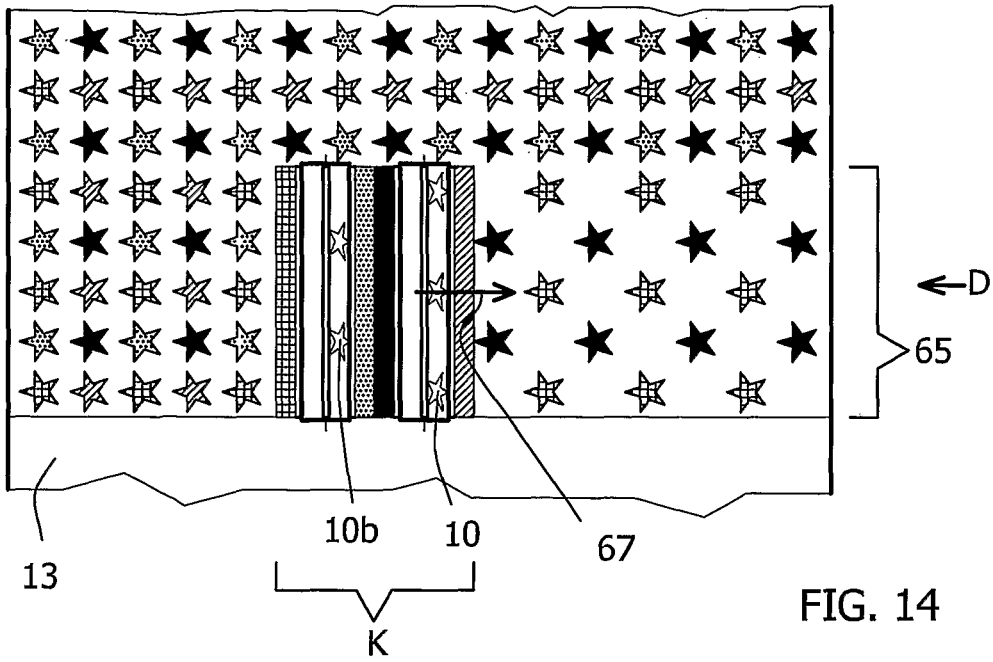
Figure 15:
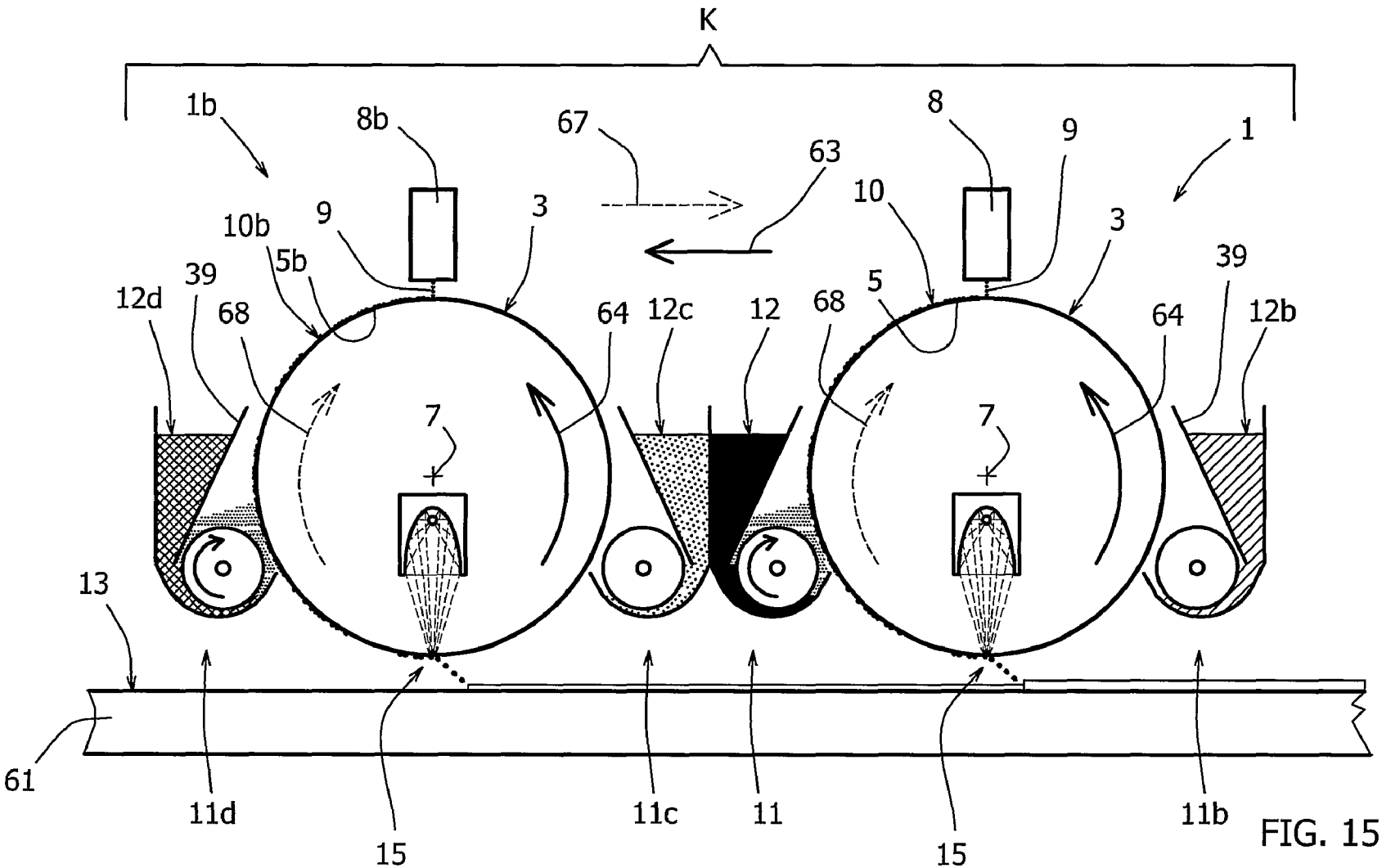
FIG. 15 is a partial XV-XV section view of FIG. 12.
Figure 16:
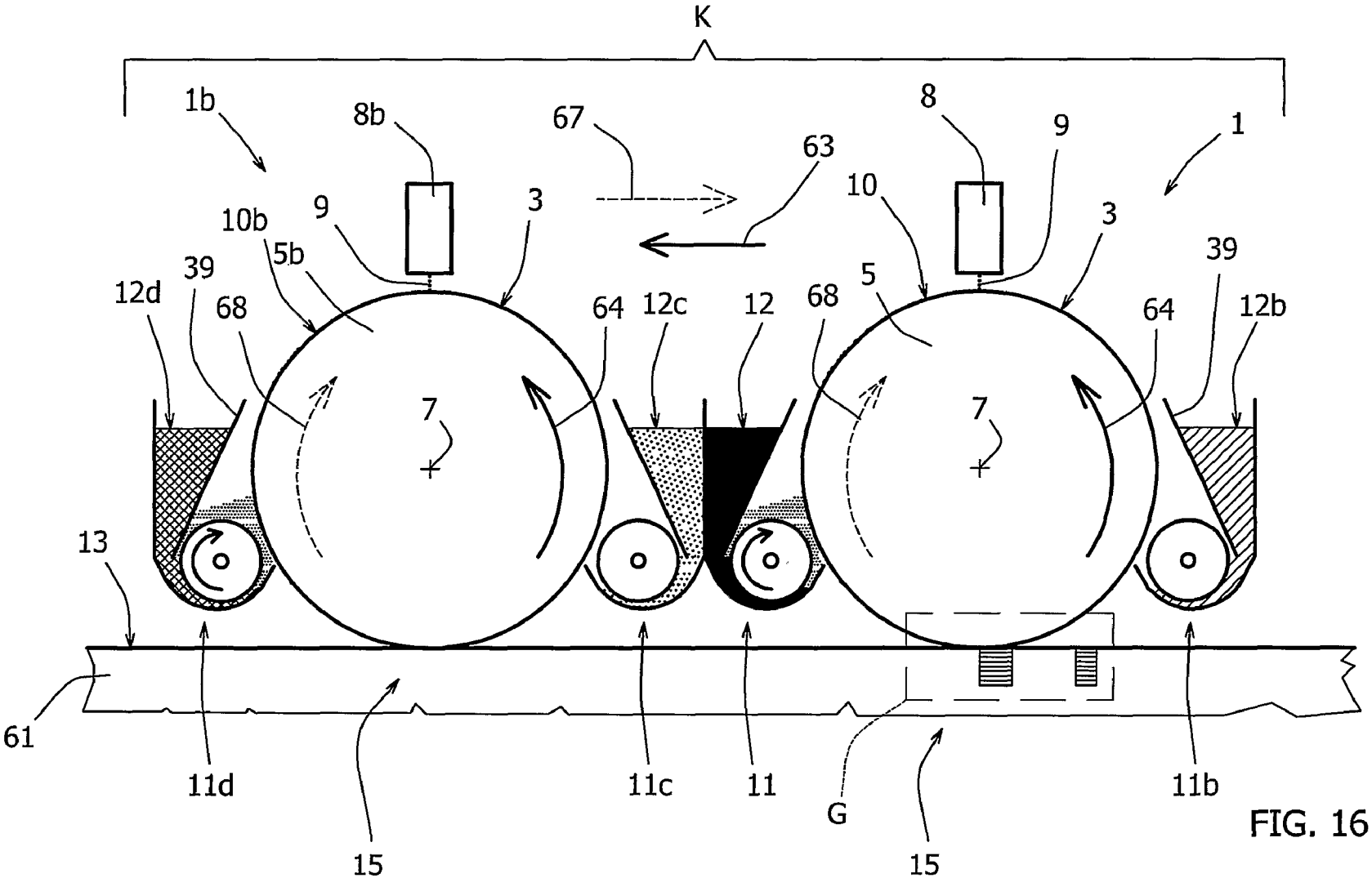
FIG. 16 is a view like the view in FIG. 15, in the last phase of in a different operating mode, suitable for causing the granular material to compenetrate in the receiving surface.

As highlighted in FIG. 12, during this translation phase 63 each of the two inkjet heads 8, 8*b* projects on the relative surface 3 the pattern 10, 10*b*, both the transferring surfaces 3 rotate in counterclockwise direction 64 and the two distributors 11, 11*d* projecting the relative materials 12, 12*d* are active. On the strip 65 of the surface 13 first the material 12*d* and at short distance the material 12 are thus deposited, in the order.

Once reached the position of end stop P2 (FIG. 13) the cycle is reversed and the complex K starts to translate in direction 67, the transferring surfaces 3 rotate in clockwise direction 68, the distributors 11, 11*d* are deactivated, the distributors 11*b* and 11*c* are activated.

In this phase, on the same strip 65 first of all the material 12*b* and after short time the material 12*c* are therefore deposited in the order and, once reached the position P1, the cycle is repeated.

Thus a pattern in four-colour printing is completed in a single decorating station D, with the four colours 12*d*, 12, 12*b*, 12*c* that are applied in this order, being superimposed on each other or placed side by side on the same plane as shown by the stars in the schematic drawing.

This configuration of apparatus is particularly suitable when the surface to be decorated is very large in width and the advance speed 62 of the surface 13 to be decorated is relatively low. Thus, large surfaces can be decorated by means of a machine of reduced size (mainly as regards the inkjet head 8), which machine is then very more simple and economical. This situation occurs generally in the decorating lines that are arranged upstream of the press, where the layer prepared for pressing has the maximal width suitable for being passed through the press and an advance speed that is relatively low and just of indexing type.

The machine can be adapted to the different width of these layers, by simply modifying the translation stroke and without losing efficiency.

The apparatus 1, 1*b* according to the invention is very versatile and as it will be explained in the following can be used with remarkable advantages even in many other ways and according to very different preparations.

First of all the advancing step 66 of the receiving surface 13 in the direction 62, can be performed at every forward translation 63 and at every backward translation 67, or can be performed only after a plurality of translations 63, 67.

In the first case the quantitative aspect of the producing speed will be preferred, in the second case the qualitative aspect will be preferred and aesthetic effects that were up to now inconceivable can be obtained, without the need of occupying further spaces or installing new plants, moreover, with the possibility of passing automatically from a situation to the other without any modification.

Some examples can better clarify these advantages, a machine being supposed with arrangement of the disclosed type, with four distributors 11.

In a first case, all four distributors 11 are filled with an identical material, the step 66 is performed at every single forward translation 63 and backward translation 67: the machine expresses in this way the maximum of the speed, maintaining the possibility of well controlling the thickness of the layer since the latter will be composed by two layers independently controlled.

In a second case, always maintaining the four distributors with identical material, the step 66 is performed after two complete forward 63 and backward 67 translations: the layer of deposited material is thus composed of eight layers of the same colour that, depending on the material that is used, can also reach some mm of thickness and with an extreme controlled modularity of this thickness.

In a third case, the four distributors are supplied with four different materials and the step 66 is performed at every single forward translation 63 and backward translation 67: the machine expresses the maximum of the speed and the decorated surface 3 is formed by strips 65 the pattern of which is defined by the combination of two colours and by strips 65 the pattern of which is defined by the combination of other two different colours. Having the measure 66 of the strip 65 corresponding to the size of the tile that will be pressed, the tiles will result similarly variegated in the colour.

In a fourth case, the four distributors are supplied with four different materials and the step 66 is performed after a complete forward 63 and backward 67 translation: the resulting pattern is formed by the unlimited combination of four colours.

In a fifth case, the machine is arranged as in the previous case, but the step 66 is performed after three complete forward 63 and backward 67 translations: the deriving decorated layer is therefore composed of twelve layers with four different colours that are distributed in a superimposed manner according to an order ABCD-ABCD-ABCD, the decorated layer will be therefore of very high thickness, will have an unlimited chromatic variety, and mainly, this feature of chromatic variety will be substantially constant in all the thickness. In order to obtain a similar result with the current state of the art, twelve separate machines should be installed in series and moreover with digital control.

It is to be specified that even though the layers are arranged in superimposed manner, a certain remixing occurs already during application since the granules of an upper layer will fill empty spaces in the lower layer. Furthermore, during firing this integration will be further intensified due to phenomena of fusion and sintering.

By varying the number of apparatuses 1 that are arranged in the complex K along the translation line 63, 67, by varying the number of colours to be used and by varying the number of translations 63, 67 between one step and the other, the possible combinations become innumerable. Moreover, with the image digital control and other measures that will be disclosed in the following these possibilities are further increased.

Various executing and working versions can be adopted, such as for example:

The surface 13 advances with continuous motion 62 and the apparatus 1 (or complex K) follows advancing thereof during the active phase of translation 63 (67), once reached the position of end stop P2 (P1) the apparatus 1 quickly retrocedes in the original position for starting the other active phase of translation 67 (63).

Two or more distributors 11, 11*b* for each side, to be supplied with four (or more) different colours, can be associated with a single transferring surface 3. In this way, each distributor 11, 11*b* will be sequentially activated at each stroke 63, 67 distributing on the strip 65 a four-color image (or a polychromy) superimposed in a plurality of closely mixed layers.

With reference to this latter version, the distributors 11, 11*b* can be positioned in a fixed manner, being positioned on subsequent zones of the transferring surface 3, or the distributors 11, 11*b* can be movable so as to be automatically positioned on the same zone of the surface 3 at every stop end of translation 63, 67.

The advantage of this version is that four or more colours can be controlled with a single inkjet apparatus 8 with sacrifice however of a lower operative speed.

Two different inkjet apparatuses can be associated with each transferring surface 3, each inkjet apparatus being activated in one of the rotation directions 64, 68 so that said inkjet apparatus operates in a more close position in relation to the corresponding distributor 11, 11*b*.

For the same reason, a single inkjet apparatus 8 can be alternatively positioned in two different stations depending on the rotation direction 64, 68.

The rotation speed 64, 68 of the transferring surface 3 can also be maintained higher or lower than the translation speed 63, 67, particularly, decorating layers 65 of high thickness can be obtained with higher rotation speed.

The receiving surface 13 can be transversally non continuous, i.e. it can consist of more parallel surfaces 13 or even of more peripherally delimited elements, for example tiles or cavities of die with parallel advancement.

In a version that is not shown, the apparatus 1 is arranged with the axis 7 that is perpendicular to the advance direction 62 of the surface 13 and it is reciprocatingly translatable parallel to said advance direction 62. In this case, while the surface 13 advances of one step, the apparatus 1 is stationary and, in the known manner, can distribute on the surface 13 the decoration of the distributor 11 that is oriented upstream. Once the surface 13 has stopped, the apparatus 1 advances by translating along the direction 62 of an amount equivalent to the step, and superimposes to the just decorated surface 13 the other decoration of the distributor 11 that is oriented downstream. Then, retroceding, the apparatus 1 will apply again the decoration of the distributor 11 that is oriented upstream. During the stop of the surface 13 both the two phases can be repeated, or the only advancing or retroceding phase can be repeated even more time, depending on the type of colour that is intended to be applied. Obviously, in this version the axial width of the apparatus 1 will coincide with the width of the surface 13.

In this disclosed example the two phases of decoration in translation are performed first in advancing then in retroceding, the two phases can however be performed even in the reversed order.

In the following a method is disclosed for applying decorating layers permeated in an incoherent substrate.

Figure 27:
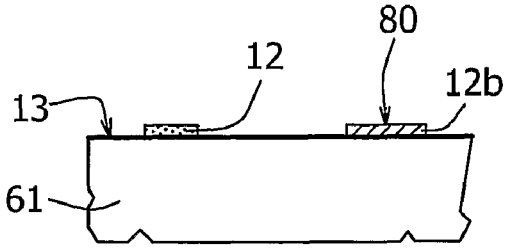
FIGS. 27 to 36 are partial and schematic section views showing subsequent phases according to the invention, in order to form decorations compenetrating the substrate.
Figure 28:
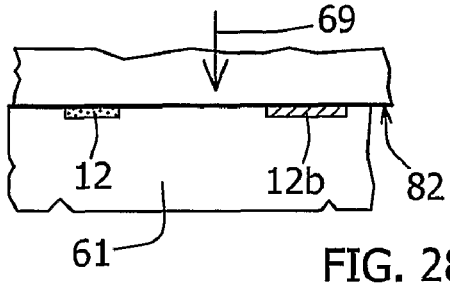
Figure 29:
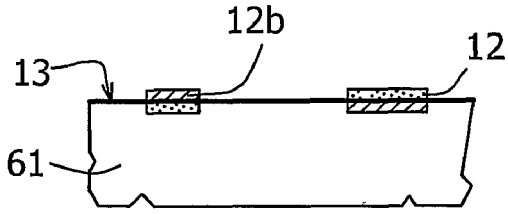
Figure 30:
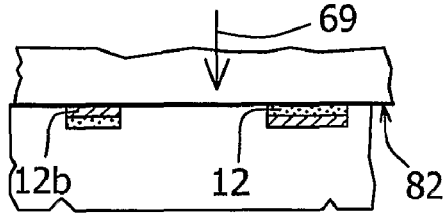
Figure 31:
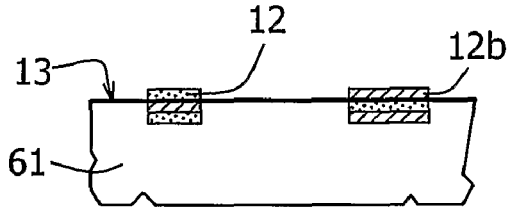
Figure 32:
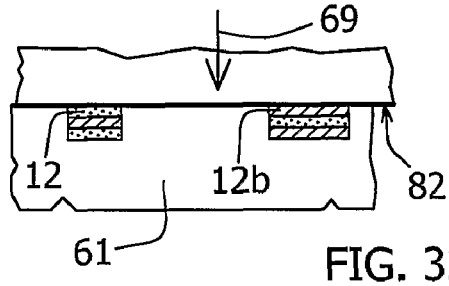
Figure 33:
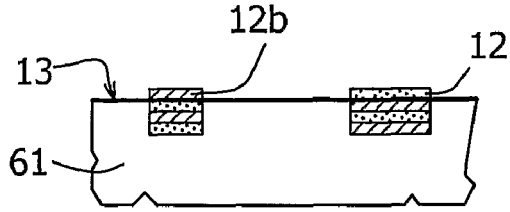
Figure 34:
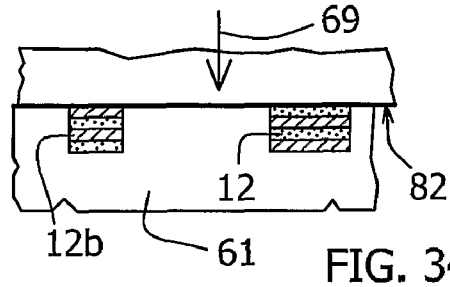
Figure 35:
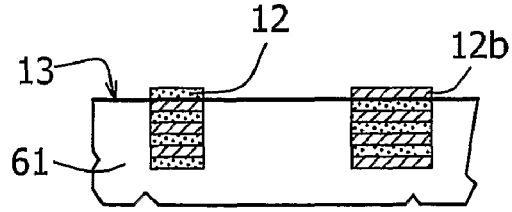
Figure 36:
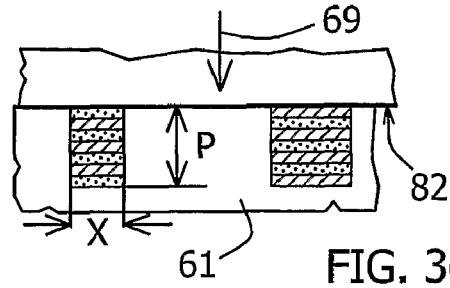

With reference to FIG. 27, on the surface 13 of a layer 61 of incoherent granular material arranged on a conveying means that is non shown (for example a conveyor belt), one or more decorations 12, 12*b* are applied by means of known techniques, the decorations 12, 12*b* being composed of coloured granular material. Therefore, the upper surface 80 of these decorations 12, 12*b* emerges with respect to the surface 13 for an amount depending on the amount of applied decoration. As shown in FIG. 28, showing a subsequent phase, by means of the lowering 69 of a levelling surface 82, these decorations 12, 12*b* penetrate inside the layer 61 and the surface 80 becomes coplanar with the surface 13. In a further phase, as shown in FIG. 29, further decorations 12, 12*b*, are applied at the previously applied decorations 12, 12*b*, and the levelling operation is repeated again (FIG. 30). As shown in the subsequent FIGS. 31 to 36, the cycle can be repeated a number of times, and each time the decoration will penetrate ever more deeply up to reach the desired depth P. The disclosed procedure enables the decoration to penetrate inside the base layer 61 without substantially spreading the decoration 12, 12*b*. If a similar thickness P of granular decoration was left all protruding with respect to the surface 13, said thickness P would unavoidably collapse forming a mound having a more or less triangular section with a base that is much larger than the dimension X. In the following pressing phase, this mound, having no lateral containment, would widen further forming therefore a very broad strip having a thickness gradually thinner and thinner toward the external edge and with a very small penetration P. A certain spreading of the dimension X may occur also in the procedure according to the invention, however this spreading is limited from time to time to the only layer of decoration emerging from the surface 13. This layer, being very thin, can not spread by far, and once the layers 12, 12*b* have penetrated, the latter are subjected to the containment effect of the base material 61 and cannot move anymore. Also in the pressing phase, which occurs by mutual and progressive approaching of the two upper and lower surfaces, the decoration cannot move in horizontal direction and will be subject only to the compressing deformation in vertical direction together with the base material 61.

As it is possible to deduce from FIGS. 27 and 28, the levelling phase can be performed after more types of decorations 12, 12*b* have been deposited, when the decorations 12, 12*b* cover different zones as in the disclosed case, but the levelling phase may also be performed after each one of the single applications.

In the disclosed example the thin layers of decoration that are superimposed are alternatively of different type 12, 12*b*, these thin layers may be however also all of the same type, in the case that a monochromatic decoration is desired.

The superimposition of more layers can be exploited not only for the above mentioned purpose of causing the decoration to penetrate, but also for mixing different colours and creating thus various chromatic gradations.

An example can clarify this concept.

Suppose to have three powders the shades of which are quite near to each of the primary colours, for example yellow (G), cyan (T) and red (R), which powders will be used for decorating two distinct zones A and B of the surface 13 with the possibility of applying these thin layers with thickness of 1 mm and 0.5 mm (but obviously also zero mm, and all the intermediate values). Suppose now to arrange these three powders G, T, R in the two zones A and B, with thickness 1 mm or 0.5 mm according to the following (repetitive) plan of superimposition:

| layer n° | Zone A (colour - thickness mm) | Zone B (colour - thickness mm) |
|---|---|---|
| 1 | R - 1 | R - 1 |
| 2 | G - 1 | G - 0.5 |
| 3 | T - 0.5 | T - 1 |
| 4 | R - 1 | R - 1 |
| 5 | G - 1 | G - 0.5 |
| 6 | T - 0.5 | T - 1 |
| 7 | R - 1 | R - 1 |
| 8 | G - 1 | G - 0.5 |
| 9 | T - 0.5 | T - 1 |

Since the thin layers will result substantially mutually remixed (mainly after the firing phase, in which integration can occur between the various colours by sintering or by fusion), a more tendentially yellow colour will appear in the zone A, a more tendentially cyan colour will appear in the zone B and, very important, this colour will be substantially constant in the whole depth P of the decoration.

This method can express the maximum of the capabilities with the real time digital control in the application of these layers. An apparatus of the already shown "complex K" type is suitable for working in the above mentioned manner and is disclosed in the following.

FIGS. 17 to 20 show how the various layers 12*d*, 12, 12*b*, 12*c* are sequentially pushed so as to penetrate by said transferring surface 3, since the transferring surface 3 is in rolling contact with the surface 13.

This contact further enables a better pattern definition to be achieved, since the decoration is not subjected to any free fall.

Figure 17:
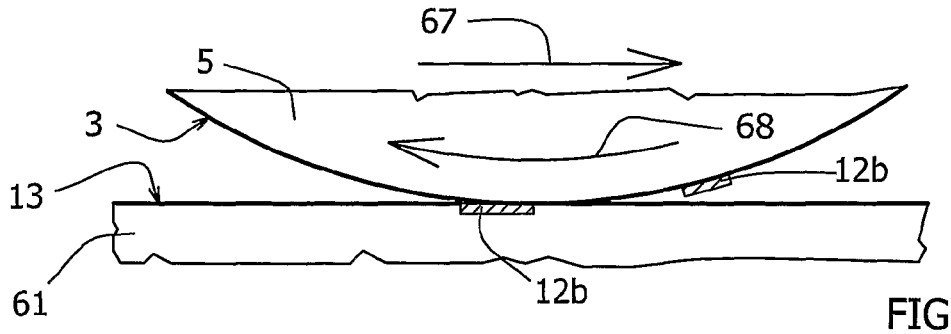
FIGS. 17, 18, 19 are schematic and enlarged section views showing three initial phases of the operating mode of FIG. 16.
Figure 18:
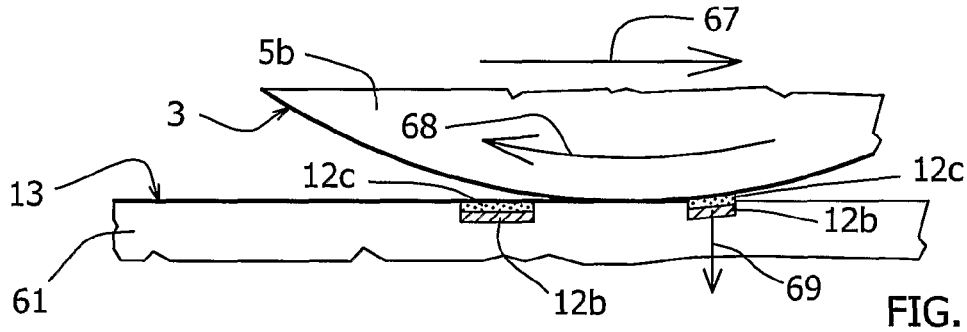
Figure 19:
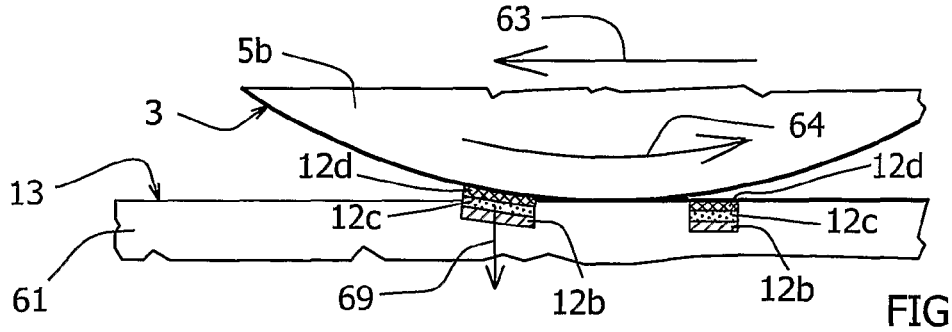
Figure 20:
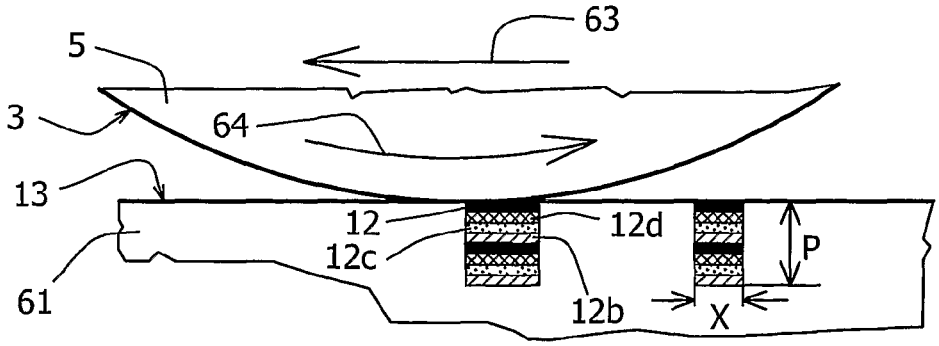
FIG. 20 is a schematic and enlarged section view of the detail G of FIG. 16.

FIGS. 17 and 18 show what occurs in the first forward stroke 67, FIG. 19 shows what occurs in the subsequent backward stroke 63 at the apparatus 1*b*. FIG. 20 shows the final result after two complete translations of forward and backward stroke.

By repeating the operation on this same station, or on a subsequent station, the desired thickness P can be achieved. It is clear that the two surfaces 3 and 13 will have to come into contact in rolling manner without mutual sliding. In the disclosed example, the surface 13 is stationary while the transferring surface 3 advances rolling thereon, but this rolling can also occur in reverse mode, being the surface 13 to advance.

The penetration push can also be given by a means that is different from the transferring surface 3, for example a roller, so that the transferring surface 3 can work without contact with the receiving surface 13.

The apparatus 1 can also not be associated with other apparatuses 1*b* of the same type in a complex K, the apparatus 1 can be stationary, and it can also have only one distributor 11.

Figure 26:
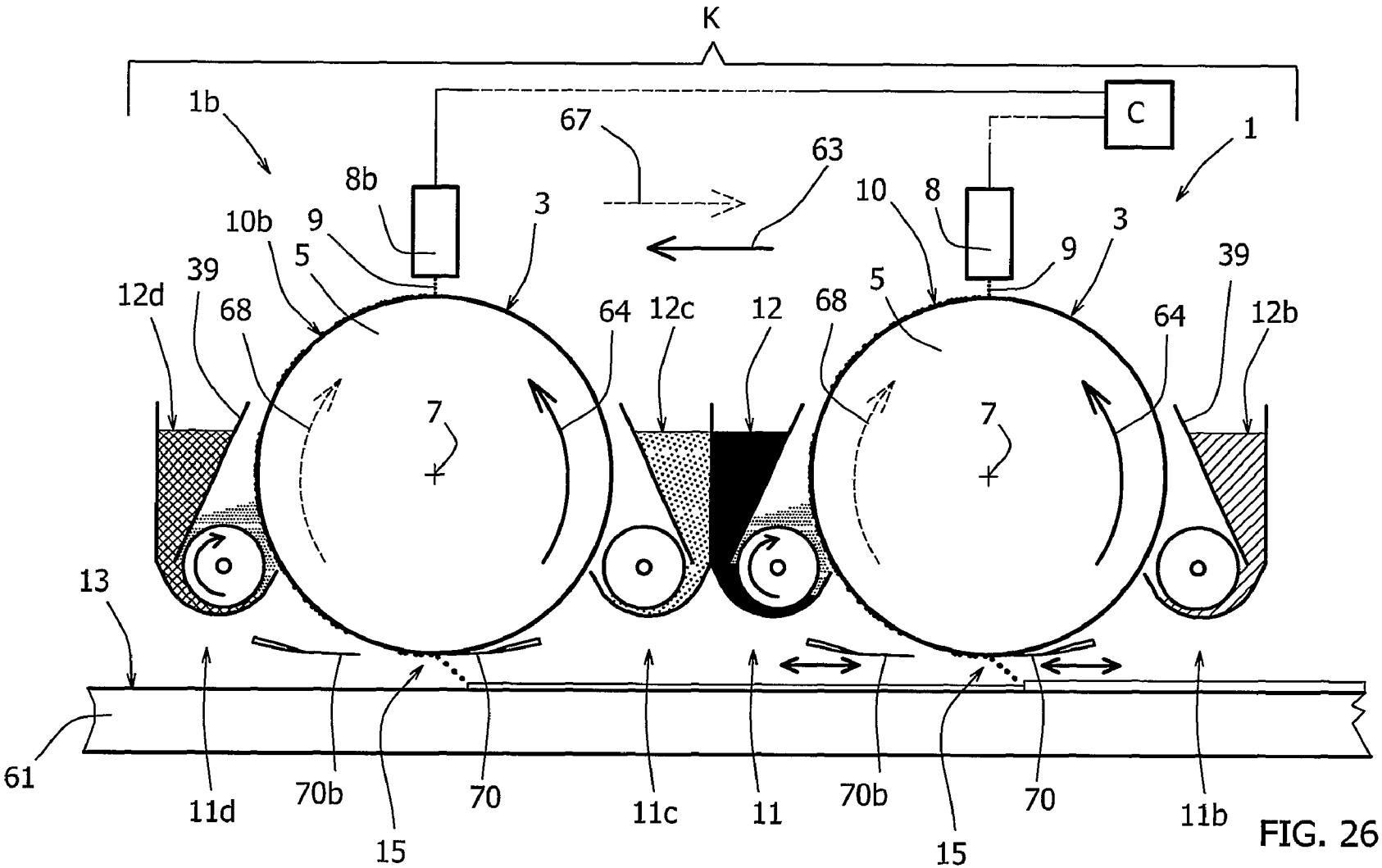
FIG. 26 is a side view similar to the view of FIG. 15, highlighting a different detaching system for detaching the material.

In the complex K shown in FIG. 26, the detachment of the granular material is achieved by scraping. In the lower portion of the transferring surface 3 facing the receiving surface 13, a transferring zone 15 is configured where there is a blade 70, the edge of which is perfectly tangent to the surface 3 in the whole length thereof. A similar blade 70*b* is placed specularly facing in a spaced apart, non-operating position. Both the blades 70, 70*b* are moved by means that is not shown, which means is able to move the blades 70, 70*b* alternatively from a passive position ad an active position of contact and vice versa, depending on the translating direction 63, 67 of the complex K.

A particular advantage of this embodiment is also that with the presence of two blades 70, 70*b*, one of which is always inactive, the edge of the blade 70, 70*b* can be kept always perfectly clean, said edge being cleaned during the stroke of translation, or better, when the edge is at the end stop, outside the surface 13. In the functioning of known type that will be impossible since the blade is operated continuously and moreover placed in a position hardly accessible.

However, to the blades 70, 70*b* all the known measures can be applied that are suitable for maintaining clean and efficient the blades 70, 70*b*, between which measures there are heating, anti-adherent coating, vibrations.

In this apparatus 1 of the complex K, the detachment of the decorating material from the transferring surface 3 can also occur in other ways, for example by means of the perturbing action of the contact with the receiving surface 13 or by means of the systems disclosed in IT1314624.

Also the formation of the digital pattern can be determined by systems different from the inkjet, for example by using the vibration selective detaching and transferring means disclosed in WO01/72489.

Figure 37:
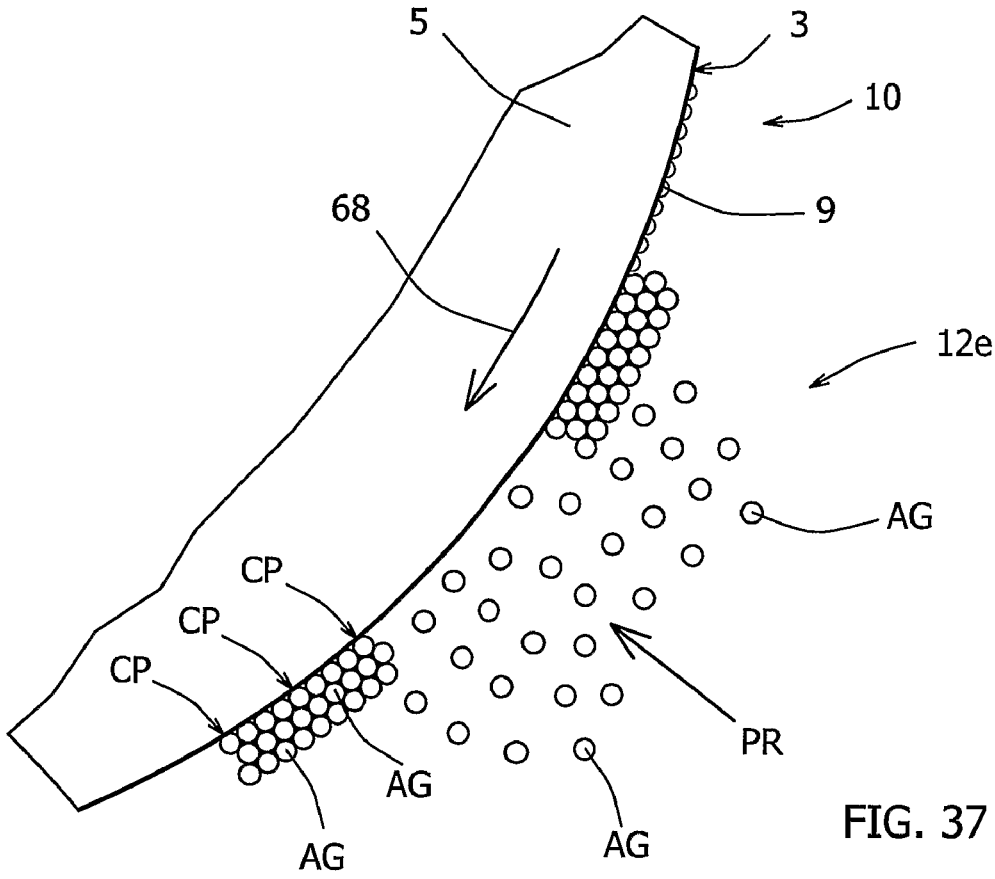
FIGS. 37 and 38 schematically show two phases of a particular operating mode of the apparatus of FIG. 16, enabling the granular material to be transferred to an incoherent substrate, through contact and compenetration.
Figure 38:
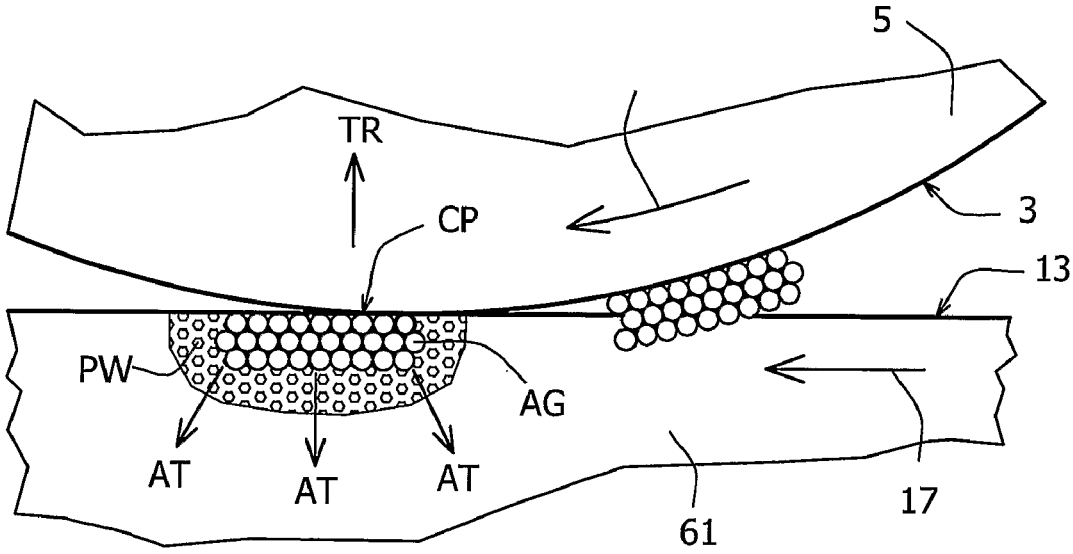

With reference to FIGS. 37 and 38 a particular manner is now explained, according to the invention, for achieving the passage of the decoration from the transferring surface 3 to the incoherent surface 13.

It is the case to point out that, in the prior art, the possibility is not provided of transferring a decoration to an incoherent surface of granular or powdered material by means of a simple adhesive effect. The transfer by adhesive effect with contact is known only for receiving surfaces of solid and coherent type and for decorating materials at the wet state. Examples of these technologies are the silk-screen printing, the intaglio printing, the ink-pad printing etc. The transfer of powders or liquid suspensions towards incoherent surfaces always occurs by means of the involvement of external forces acting on the decoration and causing the decoration to move towards the receiving surface. These forces can be the gravity force (intervening once the decoration has already been forced to pass through a matrix or has been detached from a transferring surface), electrostatic forces, vibrations, deformation of the transferring surface, air jets, etc. This involvement of external forces, together with the fact that said involvement provides to maintain a certain distance between the transferring surface and the receiving surface, does not enable good definition to be achieved. Moreover, the case of the electrostatic forces can not be applied to the normal materials for ceramic use.

As shown in FIG. 37, on the surface 3 there is the pattern 10, which is formed by the micro-drops 9 that are ejected by the inkjet apparatus 8. The decorating material 12*e*, which is projected in direction PR against the surface 3, is made of agglomerates AG of a thinly ground material, which agglomerates are obtained for example by atomization and advantageously comprise also a substantial fraction of clayey material. The agglomerates AG being porous can thus absorb by capillarity the liquid 9. Each micro-drop of liquid 9 is therefore able to capture a plurality of superimposed agglomerates 12*e* which remain adherent to the surface 3 by means of a few points of contact CP having very limited extension. The liquid 9 is prevalently distributed inside the agglomerates AG, moreover in a ratio very limited with respect to the amount of the captured agglomerates AG.

As highlighted in FIG. 38, when the agglomerates AG penetrate into the receiving surface 13, the points of contact resulting between these agglomerates AG and the particles PW of the receiving layer 61 are much more numerous and coercive than the points of contact CP, and thus the decoration AG is absorbed in the receiving layer 61.

The detachment is promoted also by that the surface 3, being smooth, incurved and rolling, is placed apart from the decoration AG and from the receiving surface 13 by "peeling". In other words, while the attraction AT of the particles PW is exerted in wide and simultaneous manner on all the agglomerates AG, the traction action TR of the transferring surface 3 on the agglomerates AG weakly applies only on a small contact area (CP) progressively moving. A factor promoting this detachment may also derive from an absorbent action exerted by the layer 61 with respect to the humidity contained in the agglomerates AG.

It is further highlighted the importance of the way in which the granular decoration is applied on the surface 3 for achieving this result. In fact, the preventive application of the liquid 9 and the subsequent association of the decorating granular material AG enables a well defined pattern to be obtained on the surface 3, said pattern being clean and of relatively high thickness, which pattern is temporarily stable but easy to be detached since the liquid 9 is present in an extremely reduced ratio and, as already said, it has a minimal adhesion surface CP. Otherwise, when a granular material already in liquid suspension was applied for example on the surface 3, in order to cause this suspension to adhere, the presence of a remarkable amount of liquid phase with extended zones of close contact between decoration and surface 3 would be required, in this way the subsequent detachment for the transfer would result impossible.

In the method according to the invention, it is instead surprising how this transfer can occur in so accurate and easy manner by exerting the only exiguous pressure needed to create the contact.

Instead of the agglomerated material AG, finely powdered material can also be used. In that case, being such a material not very flowable, it is convenient to associate said material with the liquid 9 not by projection PR, as shown in FIG. 37, but by rolling contact of a thin layer of this powdered material arranged on a belt or on a supplying roller.

Particularly in the case that materials decorating are used that are composed of non-porous granules, the detachment can be promoted by heating the transferring surface 3.

This heating can be achieved according to the methods already disclosed in FIGS. 1, 2, 6, 7, 8.

Figure 39:
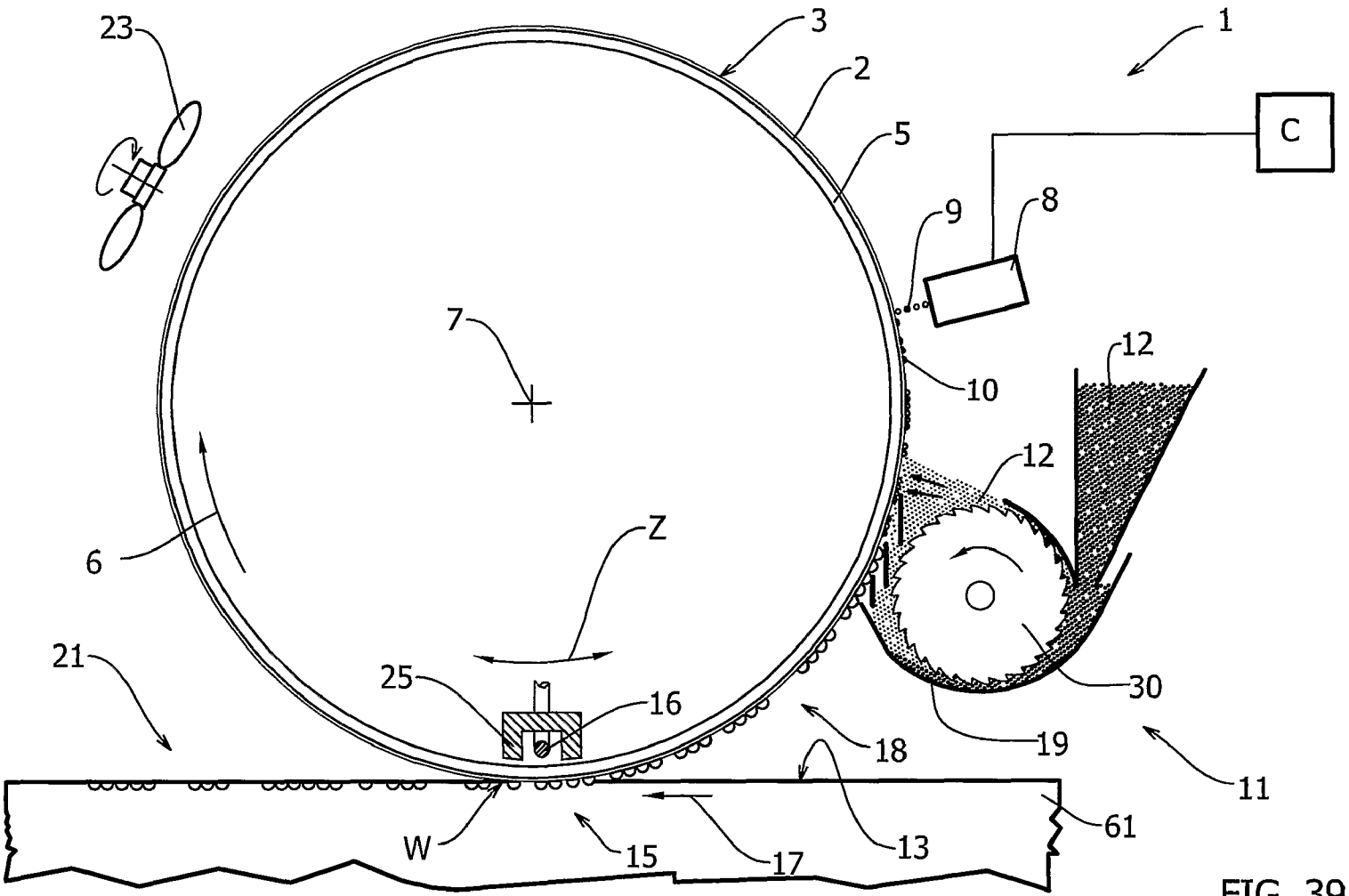
FIG. 39 is a side view of a different embodiment of the apparatus according to the invention, highlighting the operation shown in FIGS. 37 and 38, with the aid of induction heating.
Figure 40:
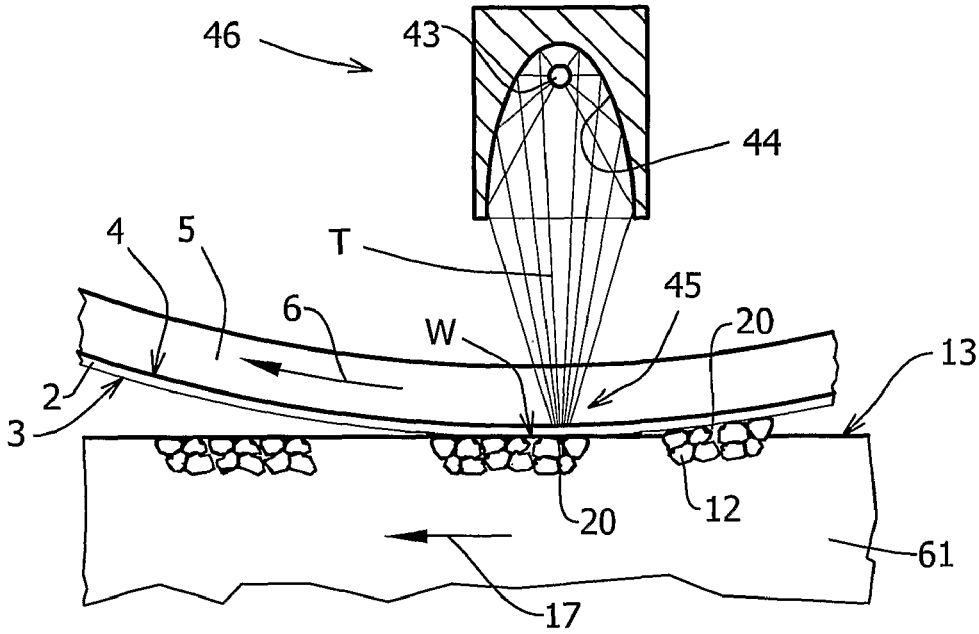
FIGS. 40 and 41 are side views of different embodiments of the apparatus according to the invention, highlighting the operation disclosed in FIGS. 37 and 38, with the aid of radiant heating.
Figure 41:
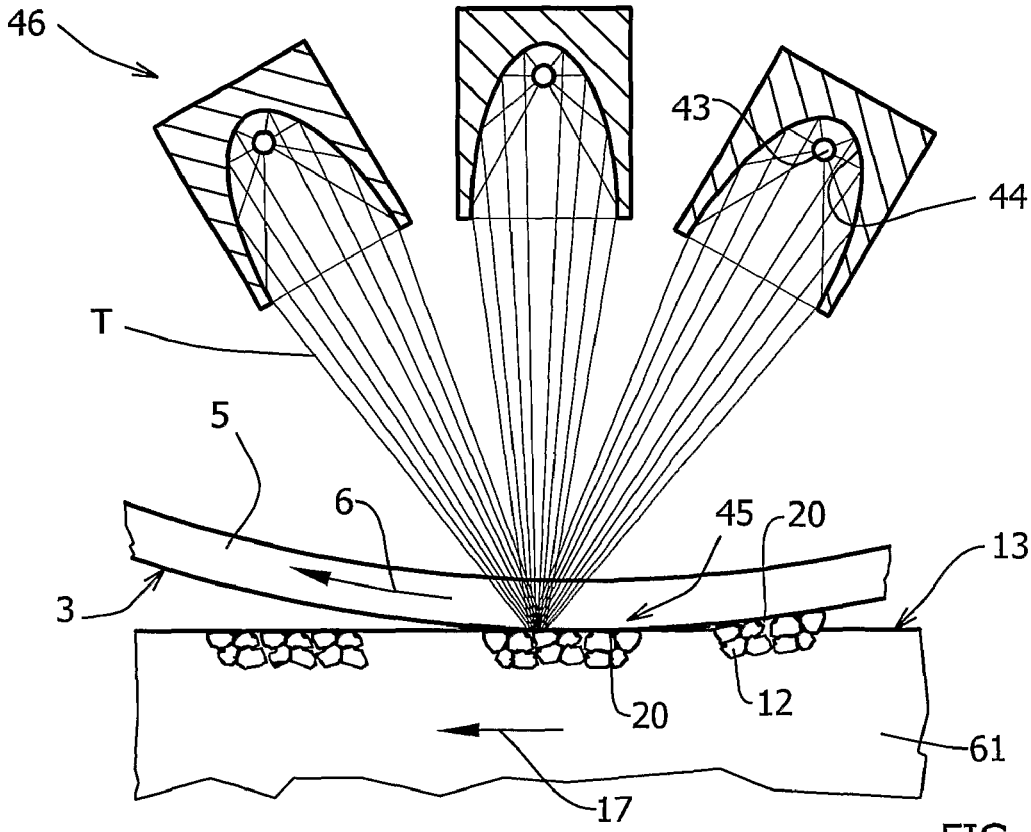

In FIGS. 39, 40 and 41 some apparatuses are shown, operating according to this transferring method by adhesion, and carrying the aforesaid heating systems.

For the transferring surface 3 the more various metallic or plastic materials may be used. However it is preferable that the surfaces are smooth and have anti-static properties. According to tests carried out, materials that have given excellent results are the stainless steel and the polypropylene.

It is pointed out that the invention achieves the prefixed objects, particularly it enables transferring with contact while maintaining unchanged the state of incoherence of the receiving layer, which condition enables different transferring operations to be successively performed, also with different superimposed decorations and with digital control of the image.

The various devices, apparatuses and means indicated and disclosed with reference to the mentioned Figures can be used alone, or in possible combinations with other devices, apparatuses and means herein indicated and disclosed, or combined with devices, apparatuses and means that are different from those indicated and disclosed.

The invention claimed is:

1. Method for applying a pattern of granular material on a receiving surface, comprising in sequence:

arranging granular material on a transferring surface by projecting said granular material from a rotating device onto said transferring surface, said rotating device further collecting an excess of said granular material that was not kept by said transferring surface; wherein the arranging further comprises, before the projecting, applying a liquid on the transferring surface according to a prefiguration of the pattern by means of an inklet device;

facing said transferring surface to said receiving surface and causing a pattern of granular material to be detached from said transferring surface and transferred onto said receiving surface; wherein said collecting comprises moving said excess into surface recesses of said rotating device along a path underlying said rotating device.

2. Method according to claim 1, wherein said collecting further comprises moving said excess towards a lower outlet of a supply arrangement for supplying said granular material, said excess thereby interacting with a flow of said granular material exiting said outlet.

3. Method according to claim 2, wherein said interacting causes said flow to be substantially equivalent to the amount of said granular material kept by said transferring surface.

4. Method according to claim 1, wherein, during said projecting, the granular material is projected from said rotating device towards a first portion of the transferring surface, said first portion facing downwards, and wherein, during said collecting, said excess is collected by said rotating device in proximity of a second portion of the transferring surface, said second portion being located downstream of the first portion and facing downwards.

5. Method according to claim 1, wherein, during said projecting, the granular material is projected from said rotating device towards a first portion of the transferring surface, said first portion facing upwards, and wherein, during said collecting, said excess is collected by said rotating device in proximity of a second portion of the transferring surface, said second portion being located downstream of the first portion and facing downwards.

6. Method according to claim 1, comprising providing said rotating device with distinct types of said granular material, said distinct types of said granular material differing from one another for their colour.

7. Method according to claim 1, wherein said receiving surface is a surface of a ceramic tile.

8. Method according to claim 1, wherein the rotating device is a cylindrical rotor.

* * * * *